US007660670B2

(12) United States Patent
Drebit et al.

(10) Patent No.: US 7,660,670 B2
(45) Date of Patent: Feb. 9, 2010

(54) SANDING ADVISOR

(75) Inventors: Gary Eugene Drebit, Calgary (CA); Brian William Smith, Bogota D.C. (CO)

(73) Assignee: Schlumberger Technology Corporation, Sugar Land, TX (US)

( * ) Notice: Subject to any disclaimer, the term of this patent is extended or adjusted under 35 U.S.C. 154(b) by 175 days.

(21) Appl. No.: 11/924,558

(22) Filed: Oct. 25, 2007

(65) Prior Publication Data

US 2008/0099198 A1 May 1, 2008

Related U.S. Application Data

(60) Provisional application No. 60/854,976, filed on Oct. 27, 2006.

(51) Int. Cl.
*G01V 1/40* (2006.01)

(52) U.S. Cl. ..... 702/6; 166/336

(58) Field of Classification Search ..... 702/6
See application file for complete search history.

(56) References Cited

U.S. PATENT DOCUMENTS

| | | | | |
|---|---|---|---|---|
| 5,497,658 | A | 3/1996 | Fletcher et al. | |
| 7,066,019 | B1 * | 6/2006 | Papanastasiou | 73/152.59 |
| 7,181,380 | B2 * | 2/2007 | Dusterhoft et al. | 703/10 |
| 7,200,539 | B2 * | 4/2007 | Ong et al. | 703/9 |
| 2002/0147574 | A1 | 10/2002 | Ong et al. | |
| 2005/0065730 | A1 * | 3/2005 | Sinha | 702/7 |
| 2007/0143020 | A1 * | 6/2007 | Bradford et al. | 702/6 |

FOREIGN PATENT DOCUMENTS

| | | |
|---|---|---|
| GB | 2351350 | 12/2000 |
| WO | 9632567 | 10/1996 |

OTHER PUBLICATIONS

Pingshuang, W. et al., Sand Production Prediction of Weizhou 12-1 Oilfield in Beibu Gulf in South China Sea, Society of Petroleum Engineers Inc., SPE 64623, Nov. 7-10, 2000, pp. 1-4 (4 pages).

Vasquez, A. R. et al., The Diagnosis, Well Damage Evaluation and Critical Drawdown Calculations of San Production Problems in the Ceuta Field, Lake Maracaibo, Venezuela, Society of Petroleum Engineers Inc., SPE 54011, Apr. 21-23, 1999, pp. 1-11 (11 pages).

Wang, Y., An Integrated Reservoir Model for Sand Production and Foamy Oil Flow During Cold Heavy Oil Production, Society of Petroleum Engineers, Inc., Mar. 12-14, 2001, SPE 69714, pp. 1-14 (14 pages).

(Continued)

*Primary Examiner*—Bryan Bui
*Assistant Examiner*—Jonathan Teixeira Moffat
(74) *Attorney, Agent, or Firm*—Osha Liang LLP

(57) ABSTRACT

The invention relates to a method for predicting zonal productivity of an oilfield drilling operation. The method includes acquiring critical drawdown pressure profile (CDPP) of at least one selected from a group consisting of an open well and a cased well, establishing a CDPP criteria according to geomechanics based model, identifying sand failure according to the CDPP criteria, and predicting zonal productivity of a drilling operation according to the sand failure.

18 Claims, 22 Drawing Sheets

OTHER PUBLICATIONS

Wang, Z. et al., A Study of Fluid-Flow Mechanism for Cold Production With Sand and Single-Well Fine Numerical Simulation in Heavy-Oil Reservoirs, SPE/PS-CIM/CHOA International Thermal Operations and Heavy Oil Symposium, SPE/PS-CIM/CHOA 9677, Nov. 1-3, 2005, pp. 1-6 (6 pages).

Weingarten, J. S. et al., Prediction of Sand Production in Gas Wells: Methods and Gulf of Mexico Case Studies, Society of Petroleum Engineers, SPE 24797, Jul. 1995, pp. 596-600 (5 pages).

Yi, X. et al., Predicting Critical Drawdown for the Onset of Sand Production, Society of Petroleum Engineers Inc., SPE 86555, Feb. 18-20, 2004, pp. 1-12 (12 pages).

International Search Report for International Application No. PCT/US2007/082667, dated Feb. 26, 2008 (5 pages).

International Search Report for International Application No. PCT/GB95/00861, dated Dec. 12, 1995 (1 page).

Search Report for Application No. GB9914505.4, dated Sep. 1, 1999 (1 page).

Haimson, B., C., and Song, I., Borehole Breakouts in Berea Sandstone: Two Porosity-Dependent Distinct Shapes and Mechanisms of Formation, prepared for presentation at the SPE/ISRM Erock '98, Trondheim, Norway, Jul. 8-10, 1998, pp. 229-238.

Heiland, J., C., and Flor, M., E., Influence of Rock Failure Characteristics on Sanding Behavior: Analysis of Reservoir Sandstones From the Norwegian Sea, prepared for presentation at the 2006 SPE International Symposium and Exhibitioon on Formation Damage Control, Lafayette, Louisiana, Feb. 15-17, 2006, pp. 1-8.

* cited by examiner

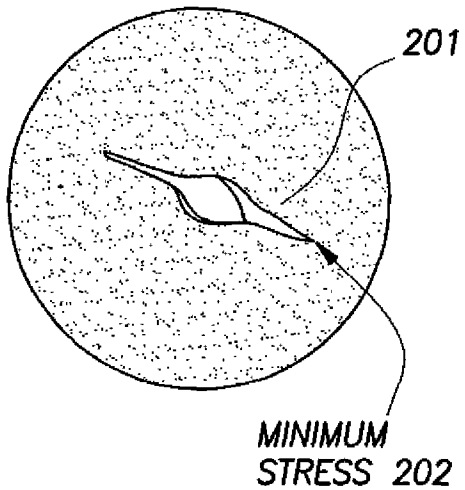

| | | SLOT-LIKE FAILURE | BREAKOUTS |
|---|---|---|---|
| GRAIN MORPHOLOGY | GRAIN SIZE DISTRIBUTION | NARROW | WIDE |
| | GRAIN SHAPE | ROUNDED TO WELL ROUNDED | ANGULAR |
| | GRAIN SIZE | "LARGE" | "SMALL" |
| GRAIN CONTACT AND BONDING PROPERTIES | GRAIN CONTACT | TANGENTIAL (POINT) | LONG (PLANAR) |
| | GRAIN BONDING | SUTURES, VERY LITTLE CLAY | CLAY CEMENT AND/OR CLAY COATING OF GRAINS |
| ADDITIONAL FACTORS | POROSITY | "HIGH" | "LOW" |
| | UCS | "LOW" | "HIGH" |
| | | | FABRIC ELEMENTS RESTRICTING REMOVAL OF GRAINS (i.e. FIBER-SHAPED PARTICLES ETC.) |
| RESULT | GRAIN BOND FAILURE AND COMPACTION | EASY | DIFFICULT |

FIG.2

| FIG. 15A | FIG. 15B |
|---|---|

SANDING ADVISOR

CROSS-REFERENCE TO RELATED APPLICATIONS

This application claims priority, pursuant to 35 U.S.C. §119(e), to U.S. Patent Application Ser. No. 60/854,976, entitled "Sanding Advisor," filed on Oct. 27, 2006, which is herein incorporated by reference in its entirety.

BACKGROUND

Cold Heavy Oil Production with Sand (CHOPS) is defined as primary heavy oil production that involves the deliberate initiation of sand influx into a perforated oil well, and the continued production of substantial quantities of sand along with the oil, perhaps for many years. CHOPS is a non-thermal primary method using high pressure drops in the formation, such as a sedimentary rock bed. Sand is produced along with heavy oil. It is feasible to achieve oil rates of 5-20 $m^3$ per day. Around 15-20 percent of original oil in place can be extracted. The produced fluid may contain 1-8 percent sand. Average well life may be 5-8 years. It is typical to have high initial oil rate followed by a gradual decline. CHOPS well operations are feasible at low enough pressure to allow continuing sand production.

Wormholes, or high porosity, high permeability channels, tend to develop and grow in the weakest sand and toward highest pressure gradient. Wormholes may not grow from each perforation of the oil well; however they tend to be stable when they do develop. For many operators of CHOPS, oil wells are drilled based on evaluation of porosity and resistivity log measurements of reservoirs, which are subsurface rock bodies having sufficient porosity and permeability to store and transmit oil. The drilled wells usually contain apparent pay sections of sufficient cumulative pay thickness to Justify casing and completion. However, what is not so apparent is how productive those pay sections may be in production. As used herein, the term "pay" refers to a reservoir or portion of a reservoir that contains economically producible oil contents, and the term "completion" refers to configuring a production casing string set across the reservoir interval and perforated to allow communication between the formation and wellbore.

Conventional practice is to select sand with the highest porosity and resistivity along the wellbore, then perforate these areas and attempt to produce from these sands. This method has shown results with a less than 50 percent success rate. As an example, FIG. 1 shows log measurements of two oil wells in the vicinity of each other. The log measurements are identified by the oil well number 1-34-XX-XX and 16-27-XX-XX. The target depth for wellbore perforation is marked in locations 101, 102, 103, and 104, which has been identified by a conventional criteria of porosity greater than 24 percent and resistivity greater than 10 ohm.m. The pay thickness of the oil well 1-34-XX-XX has been determined to be 4 meters while that of the oil well 16-27-XX-XX was determined to be 6 meters. However, the cumulative production outputs of these two wells, at 654 $m^3$ and 17500 $m^3$ respectively, clearly do not correlate with the apparent pay thickness.

FIG. 2 shows a specimen cross section of a sanding experiment and related characteristics. The sanding experiment predicts that sand failure, shown as a slot-like failure 201 in FIG. 2, will propagate in the minimum stress direction 202. This experiment, as well as other similar experiments and researches in related fields relate to sands, in general, and do not make references to wormholes in heavy oil production or its application in the field. Specifically, in the prior art, sand production has been viewed as a common and very damaging problem in hydrocarbon production from elastic reservoir beds. On the other hand, CHOPS has been viewed as a low cost operation and therefore research efforts have been limited.

Related geomechanical research has been published by Bezalel Haimson et al., "Borehole Breakouts in Berea Sandstone: Two Porosity-Dependent Distinct Shapes and mechanisms of Formation" SPE/ISRM 47249, SPE/ISRM Eurock 1996, Trondheim, Norway, 8-10 Jul. 1996 and Julian Heiland et al., "Influence of Rock Failure Characteristics on Sanding Behavior: Analysis of Reservoir Sandstones from the Norwegian Sea" SPE 98315, 2006 SPE International Symposium and Exhibition on Formation Damage Control, Lafayette, L. A., 15-17 Feb. 2006.

SUMMARY

In general, in one aspect, the invention relates to a method for performing operations of an oilfield having at least one wellsite, a surface network, and a process facility, each wellsite having a wellbore penetrating a subterranean formation for extracting fluid from an underground reservoir therein. The method comprises acquiring critical drawdown pressure profile (CDPP) of at least one selected from a group consisting of an open well and a cased well, establishing a CDPP criteria according to geomechanics based model, identifying sand failure according to the CDPP criteria, and predicting zonal productivity of a drilling operation according to the sand failure.

In general, in one aspect, the invention relates to a method for performing operations of an oilfield having at least one wellsite, a surface network, and a process facility, each wellsite having a wellbore penetrating a subterranean formation for extracting fluid from an underground reservoir therein. The method comprises predicting a direction of sand failure propagation based on a geomechanics based model in proximity of a well and maintaining a no drilling zone adjacent to the well along the direction of sand failure propagation.

In general, in one aspect, the invention relates to a computer readable medium, embodying instructions executable by the computer to perform method steps for performing operations of an oilfield having at least one wellsite, a surface network, and a process facility, each wellsite having a wellbore penetrating a subterranean formation for extracting fluid from an underground reservoir therein. The instructions comprise functionality to acquire critical drawdown pressure profile (CDPP) of at least one selected from a group consisting of an open well and a cased well, establish a CDPP criteria according to geomechanics based model, identify sand failure according to the CDPP criteria, and predict zonal productivity of a drilling operation according to the sand failure.

In general, in one aspect, the invention relates to a computer readable medium, embodying instructions executable by the computer to perform method steps for performing operations of an oilfield having at least one wellsite, a surface network, and a process facility, each wellsite having a wellbore penetrating a subterranean formation for extracting fluid from an underground reservoir therein. The instructions comprise functionality to predict a direction of sand failure propagation based on a geomechanics based model in proximity of a well and maintain a no drilling zone adjacent to the well along the direction of sand failure propagation.

In general, in one aspect, the invention relates to a computer system comprising a memory comprising a set of instructions and a processor operably coupled to the memory, wherein the processor executes the set of instructions to acquire CDPP of at least one selected from a group consisting of an open well and a cased well, establish a CDPP criteria according to geomechanics based model, identify sand failure according to the CDPP criteria, and predict zonal productivity of a drilling operation according to the sand failure.

Other aspects and advantages of the invention will be apparent from the following description and the appended claims.

BRIEF DESCRIPTION OF DRAWINGS

FIG. 2 shows a specimen cross section of a sanding experiment and related characteristics.

DETAILED DESCRIPTION

Figure 1:
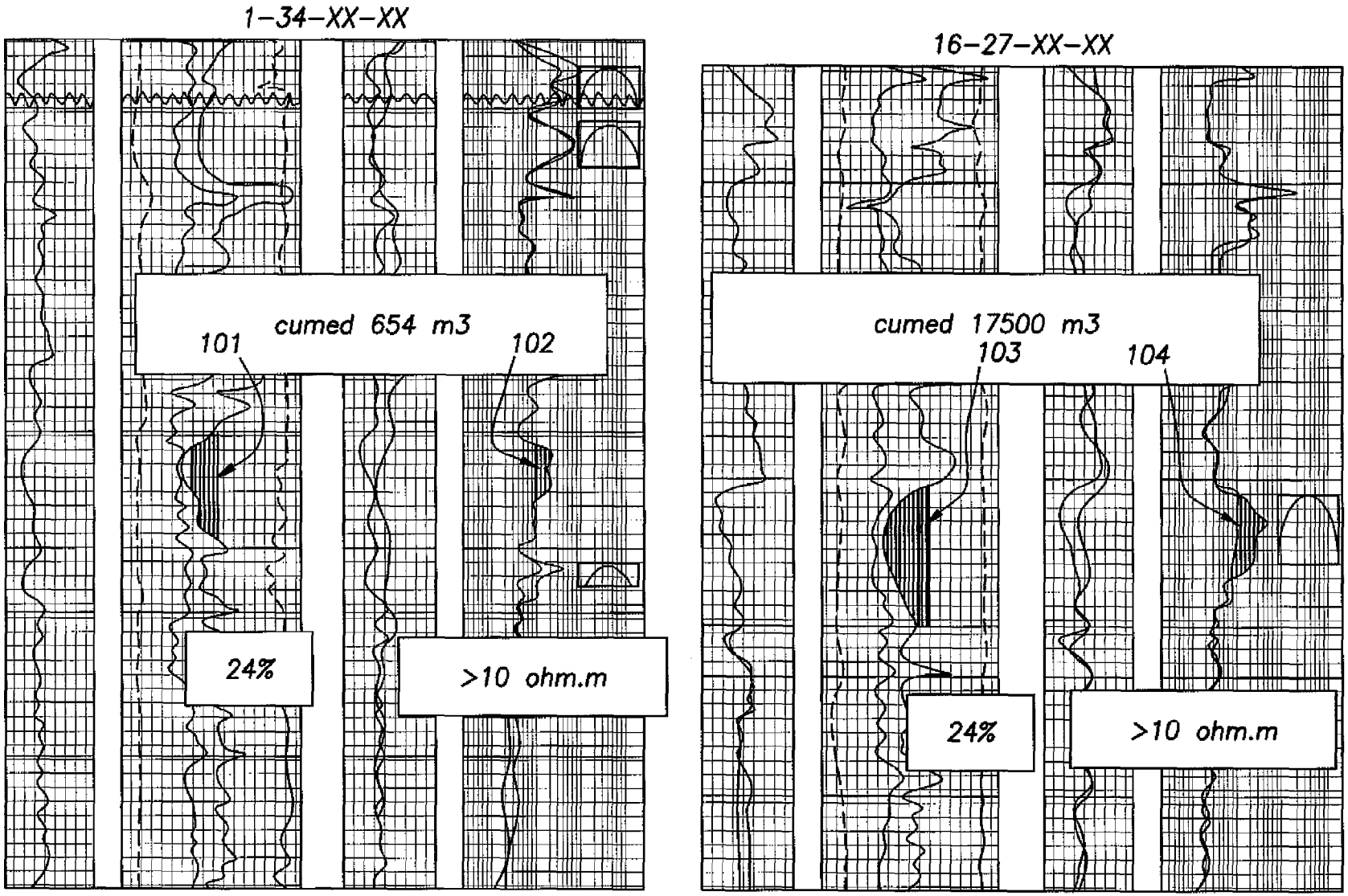
FIG. 1 shows log measurements of two oil wells in the vicinity of each other.

An example of the invention will now be described in detail with reference to the accompanying figures. Like elements in the various figures are denoted by like reference numerals for consistency. Further, the use of "ST" in the drawings is equivalent to the use of "Step" in the detailed description below.

In examples of the invention, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

In general, in one aspect, the invention relates to analytical methods for CHOPS for improving the ability in predicting well productivity in a drilling operation and optimizing well placement. More specifically, the invention relates to a process using log measurements and sand measurement techniques to derive critical drawdown Pressure (CDDP) profiles and criteria in heavy oil sands. The CDDP allows prediction of where sands will fail and therefore the zone(s) that will produce sand with oil, through creation of a high permeability channel in the sand, which enhances the productivity of the drilling operation in a CHOPS production scenario. When combined with directional logging information, the method predicts the direction of sand failure which, in turn, allows the operator to optimize the drilling pattern and well placement.

Figure 3:
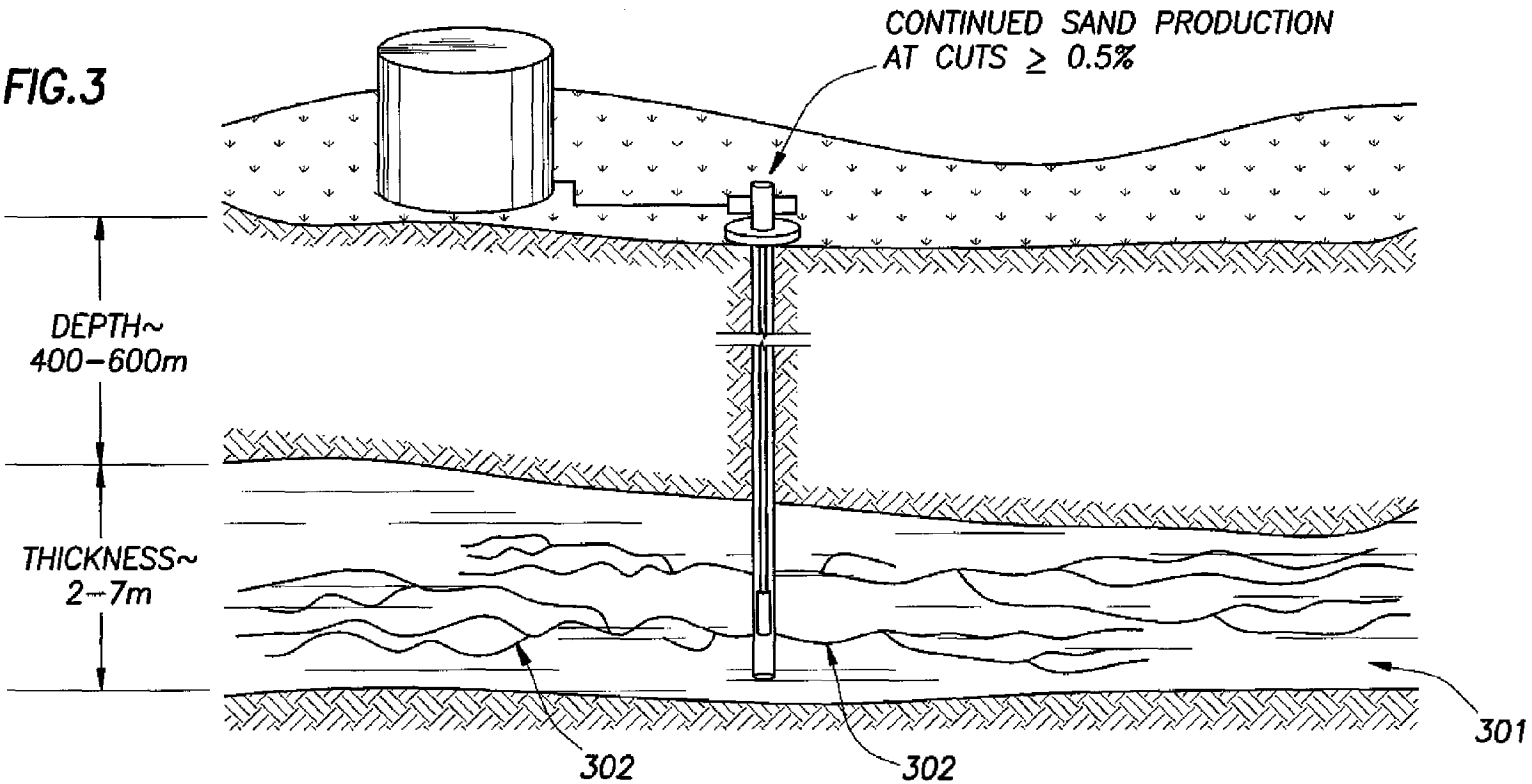
FIG. 3 shows a cross section diagram of a reservoir with wormholes in accordance with aspects of the invention.

FIG. 3 shows a cross section diagram of a reservoir with wormholes in accordance with aspects of the invention. In FIG. 3, an oil well is shown to penetrate around 400 m-600 m below surface to reach a pay section 301 with an apparent pay thickness of 2-7 m. The pay section is shown with wormholes 302. The development of these high permeability channels may provide much greater reservoir access and result in substantial increase in oil rates for a successful commercial process. One skilled in the art will appreciate that the invention may also be practiced in extracting other mineral substances, such as fluid, from subsurface reservoirs.

Sand failures may occur at the ends of channels as wormholes develop toward the high pressure gradient. The key to predict the productivity of the oil well is to predict sand failure. The productivity is directly related to the sand strength. Inducing failure of a pay sand, by exceeding its critical drawdown pressure (CDPP), creates a producing sand. This correlation is called the Drebit-Smith Correlation throughout this document. As used herein, the term "drawdown" refers to pressure difference between the formation and the wellbore. If failure is not achieved, the zone will not produce from the apparent reserves of the pay sand. The CDPP allows prediction of the location of sand failure and, when combined with directional logging information, the direction of sand failure which allows the operator to optimize the drilling pattern in identifying well locations.

Figure 4:
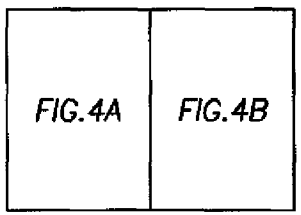
FIG. 4 shows an exemplary log measurement in accordance with aspects of the invention.
Figure 4A:
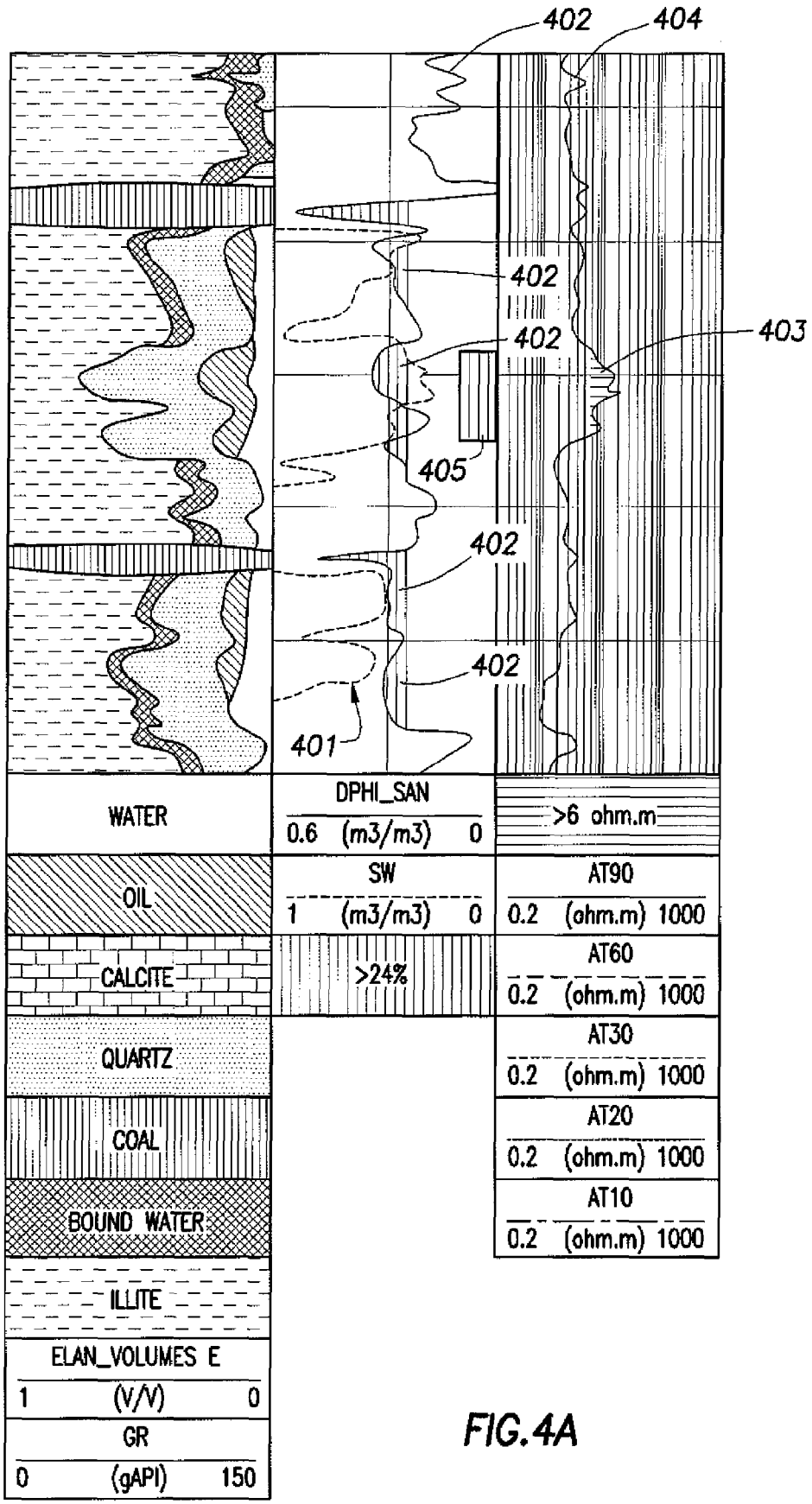
Figure 4B:
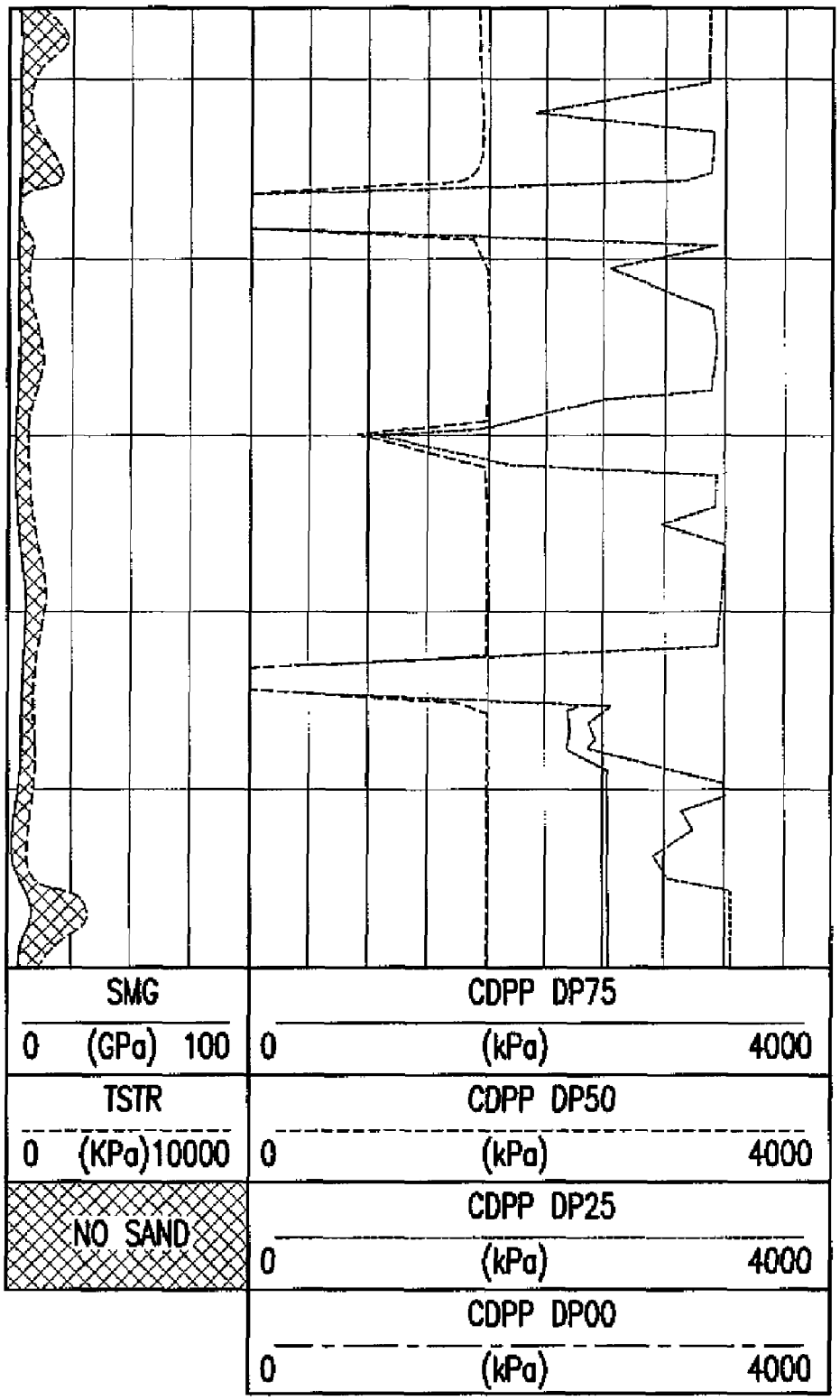

FIG. 4 shows a log measurement in an open well in accordance with aspects of the invention. The vertical axis of each track represents subsurface depth. Here the dashed trace 401 marked "SW" represents water saturation. The solid trace 402 marked "DPHI_SAN" represents porosity measurement where area with porosity greater than 24% is highlighted in locations marked 402. The other solid trace 404 marked ">6 ohm.m" represents resistivity measurement where area with resistivity greater than 6 ohm.m is highlighted in the location marked 403. The area 405 corresponds to highest porosity and resistivity and is selected for perforation according to conventional practice. However, the corresponding CDPP measurements fall in the range from 400 kPa to 1200 kPa. This range is determined to be too high for inducing sand failure for wormholes to develop around the wellbore. Therefore this oil well is predicted to be a poor producer according to the Drebit-Smith Correlation.

Figure 5:
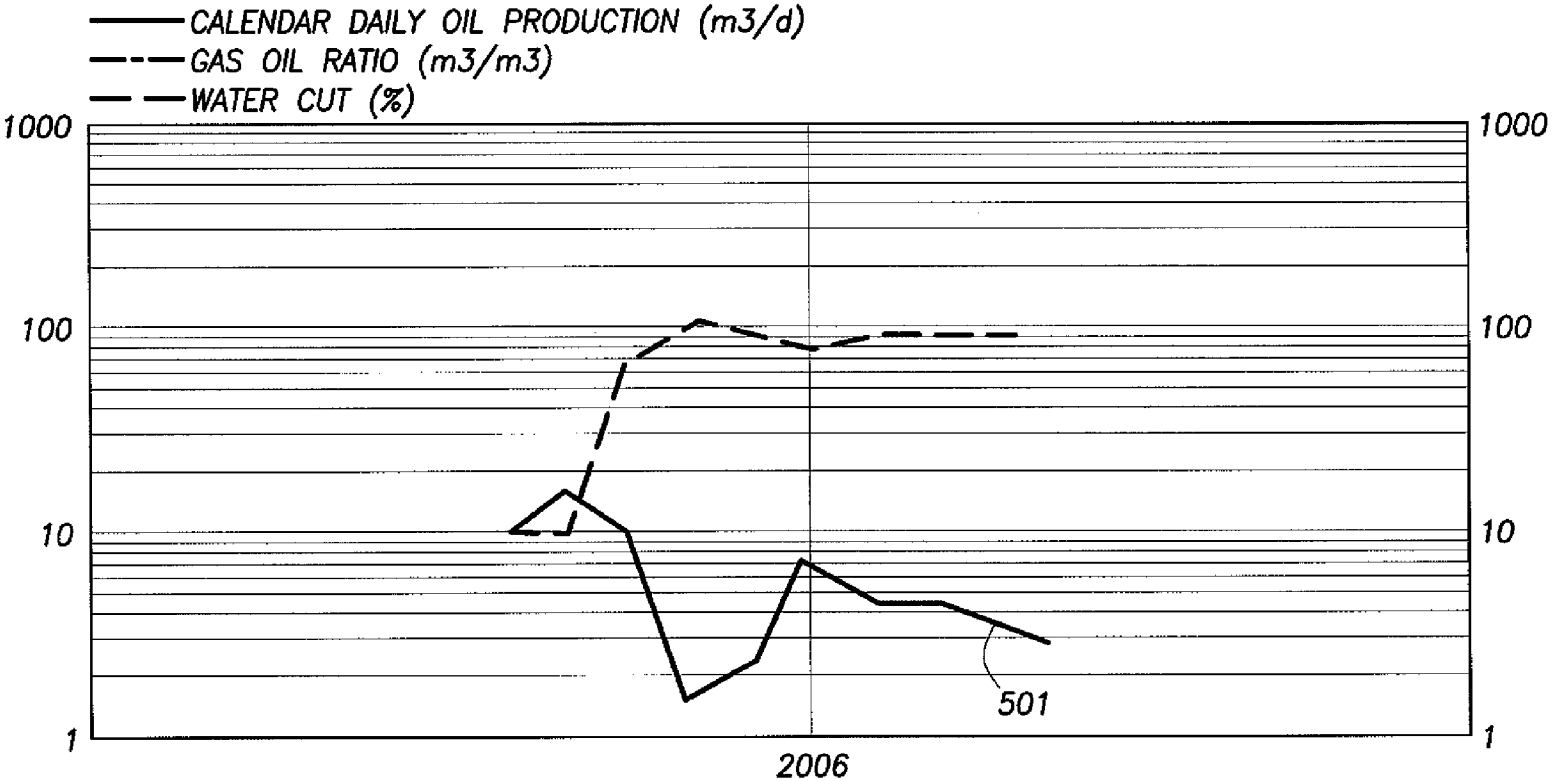
FIG. 5 shows the oil production log corresponding to FIG. 4 in accordance with aspects of the invention.

FIG. 5 shows the oil production log corresponding to FIG. 4 in accordance with aspects of the invention. Here the solid trace 401 shows a high initial daily oil production of 10 $m^3$/d quickly declining to less than 3 $m^3$/d. This is consistent with the prediction according to the CDPP log measurements from FIG. 4.

Figure 6:
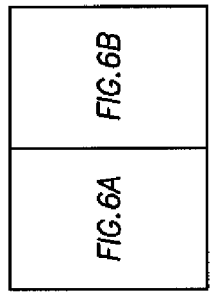
FIG. 6 shows an exemplary log measurement in accordance with aspects of the invention.
Figure 6A:
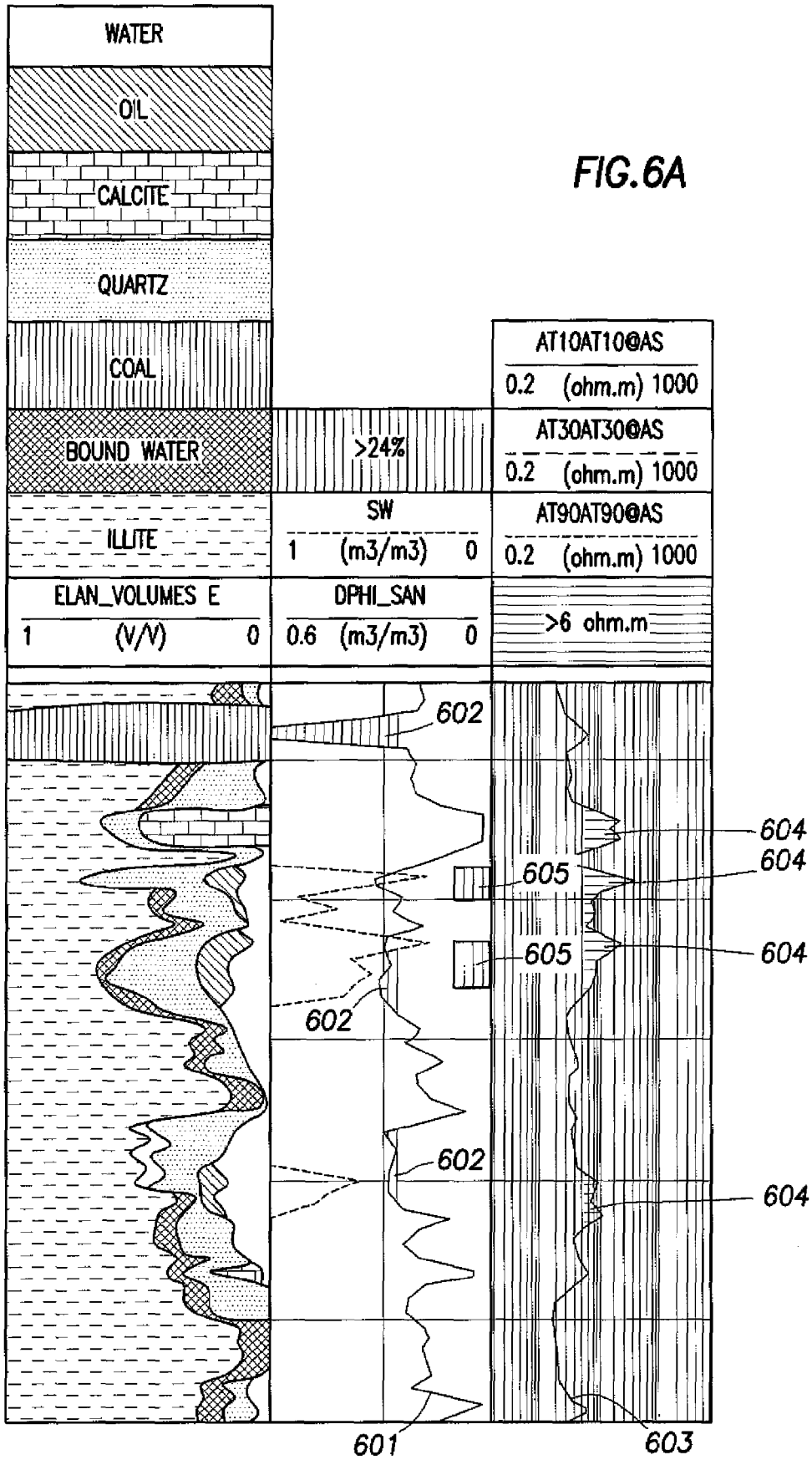
Figure 6B:
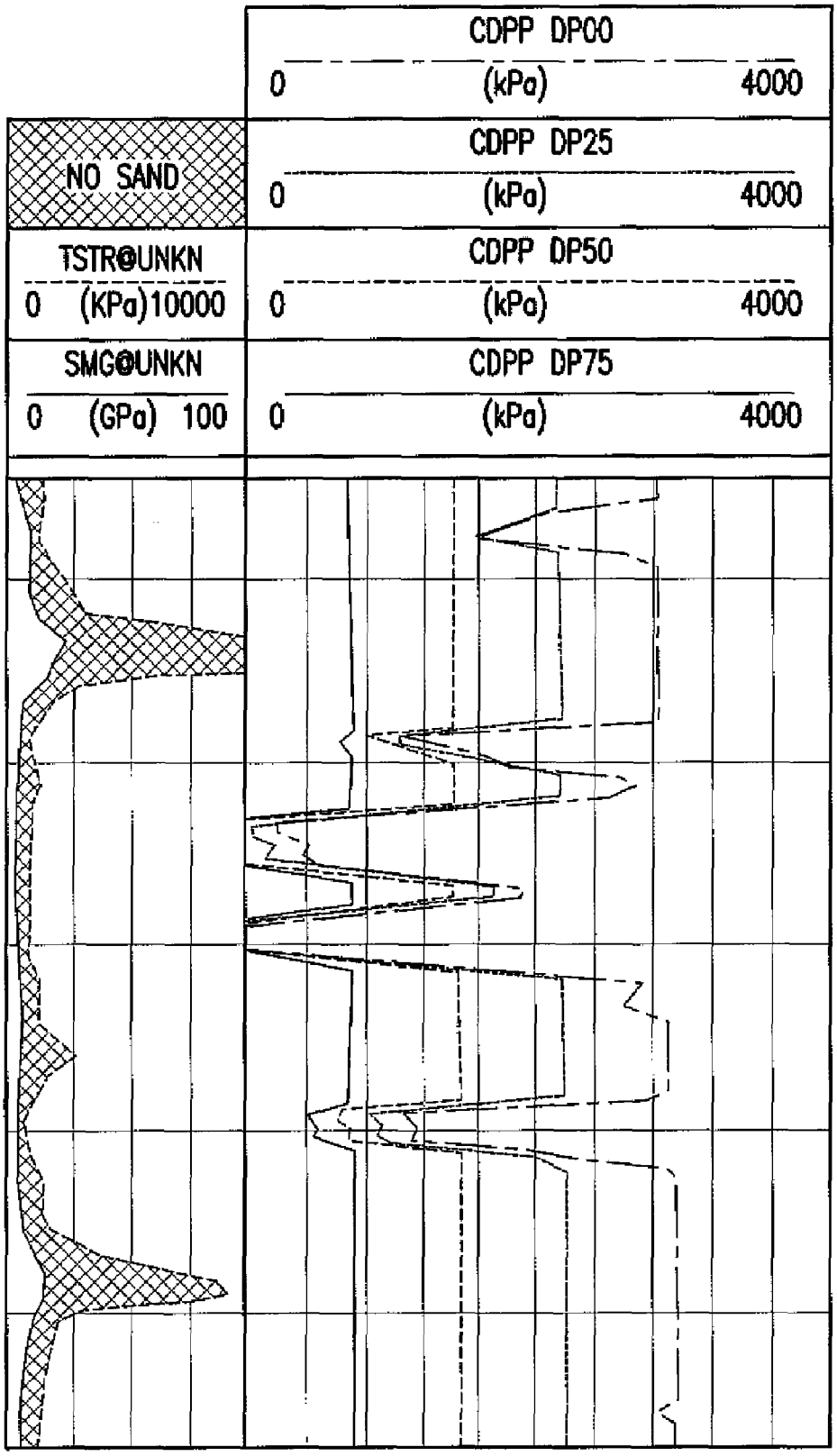

FIG. 6 shows an exemplary log measurement in an open well in accordance with aspects of the invention. The solid trace 601 marked "DPHI_SAN" represents porosity measurement where area with porosity greater than 24 percent is highlighted in locations marked 602. The other solid trace 603 marked ">6 ohm.m" represents resistivity measurement where area with resistivity greater than 6 ohm.m is highlighted in locations marked 604. The two areas 605 correspond to highest porosity and resistivity and are selected for perforation according to conventional practice. The CDPP measurements corresponding to the shallower mark falls in the range from 600 kPa to 1200 kPa. This range is determined to be too high for inducing sand failure for wormholes to develop around the wellbore. The CDPP measurements corresponding to the deeper mark falls in the range from 0 kPa to 400 kPa. This range is determined to be sufficiently low for inducing sand failure for wormholes to develop around the wellbore. Therefore, the wellbore perforation at this location is predicted to be a good producer according to the Drebit-Smith Correlation.

Figure 7:
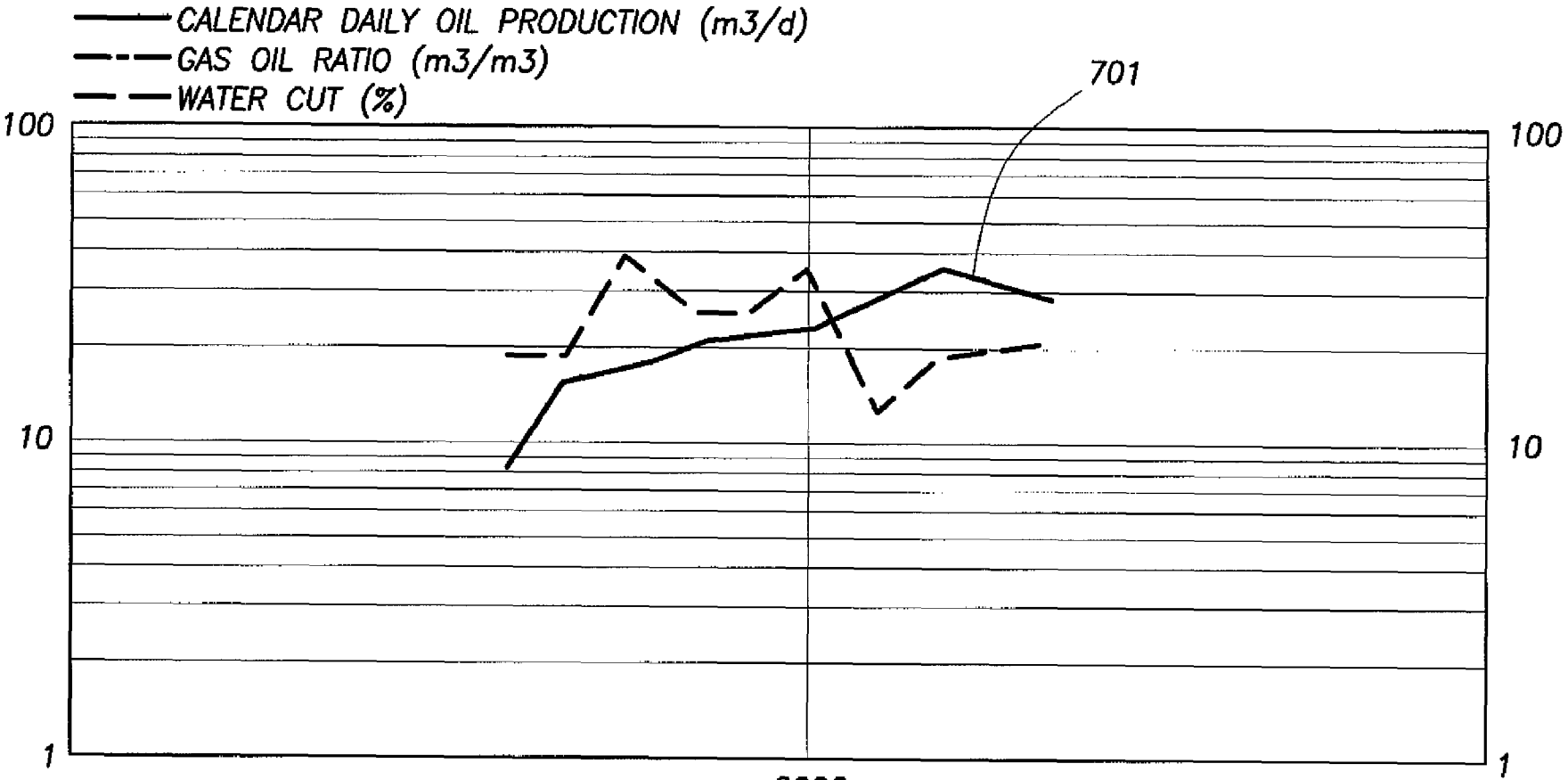
FIG. 7 shows the oil production log corresponding to FIG. 6 in accordance with aspects of the invention.

FIG. 7 shows the oil production log corresponding to FIG. 6. In FIG. 7, the solid trace 701 shows an initial daily oil production of 8 $m^3$/d quickly increasing to more than 30 $m^3$/d. This is consistent with the prediction according to the CDPP log measurements from FIG. 6.

Figure 8:
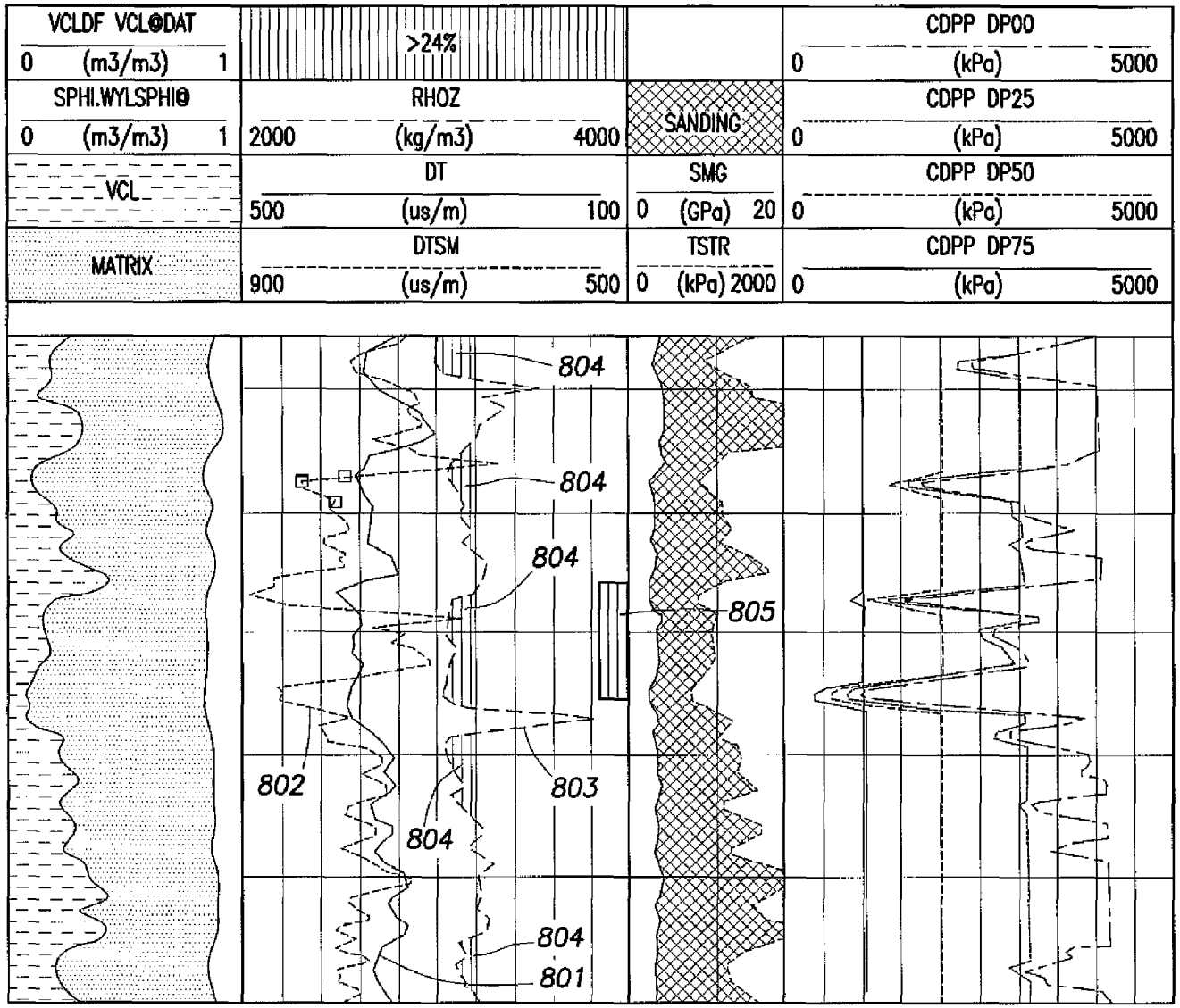
FIG. 8 shows an exemplary log measurement in accordance with aspects of the invention.

FIG. 8 shows a log measurement in a cased well in accordance with aspects of the invention. The solid trace 801 marked "DT" represents a compressional component of stress measurement. The dashed trace 802 marked "DTSM" represents a shear component of stress measurement. The dashed trace 803 marked "RHOZ" represents porosity measurement where area with porosity greater than 24 percent is highlighted in locations marked 804. The area 805 is selected for perforation according to conventional practice. However, the corresponding CDPP measurements fall in the range from 400 kPa to 3000 kPa. This range is determined to be too high for inducing sand failure for wormholes to develop around the wellbore. Therefore, this oil well is predicted to be a poor producer according to the Drebit-Smith Correlation. It is also noticed that the shear component of stress measurement correlates well in this area with the CDPP and is one of the driving forces of the Drebit-Smith Correlation.

Figure 9:
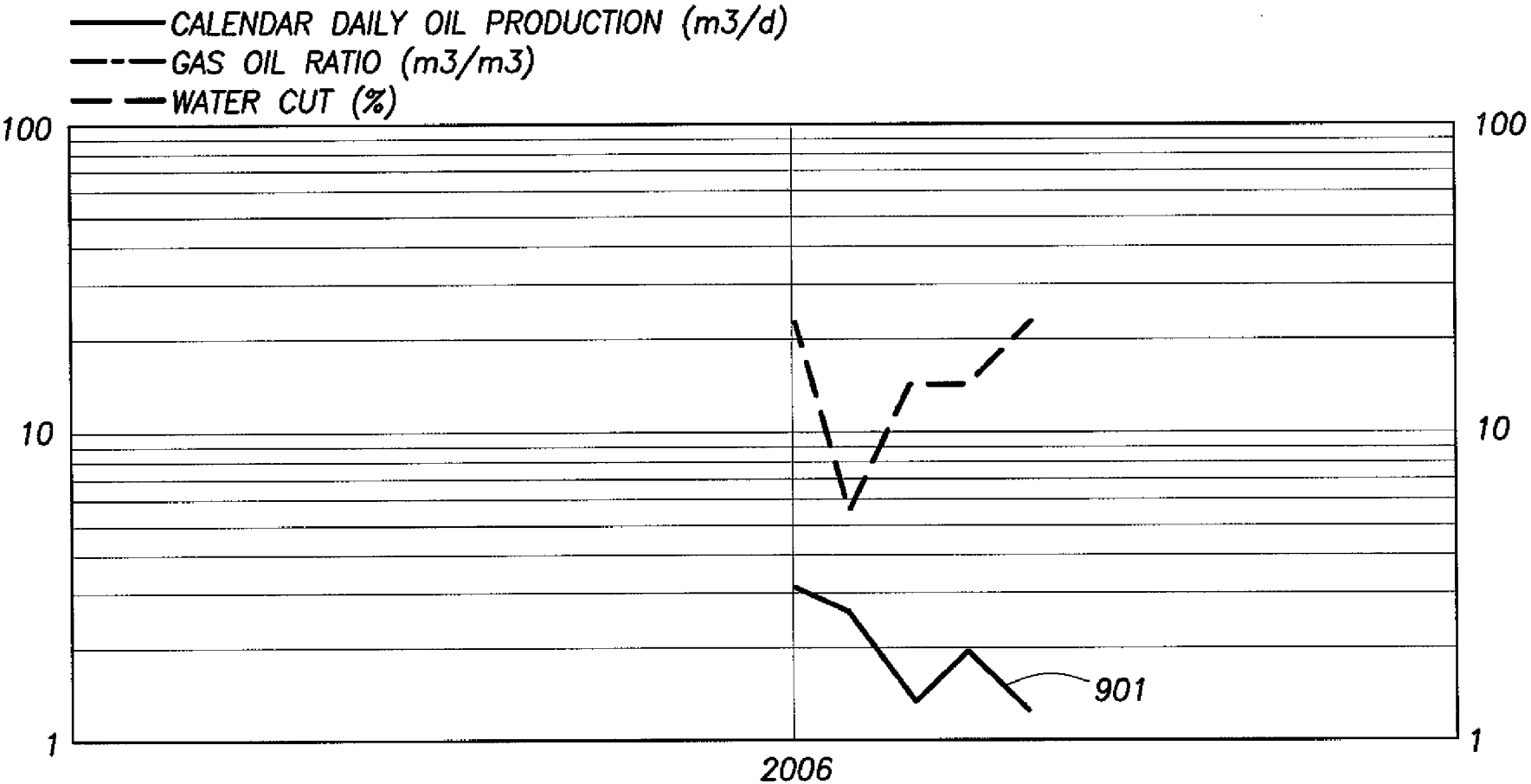
FIG. 9 shows the oil production log corresponding to FIG. 8 in accordance with aspects of the invention.

FIG. 9 shows the oil production log corresponding to FIG. 8 in accordance with aspects of the invention. In FIG. 9, the solid trace 901 shows a low initial daily oil production of 3 $m^3$/d quickly declining to less than 2 $m^3$/d. This is consistent with the prediction according to the CDPP log measurements from FIG. 8.

FIG. 9 shows the oil production log corresponding to FIG. 8 in accordance with aspects of the invention. In FIG. 9, the green trace shows a low initial daily oil production of 3 $m^3$/d quickly declining to less than 2 $m^3$/d. This is consistent with the prediction according to the CDPP log measurements from FIG. 8.

Figure 10:
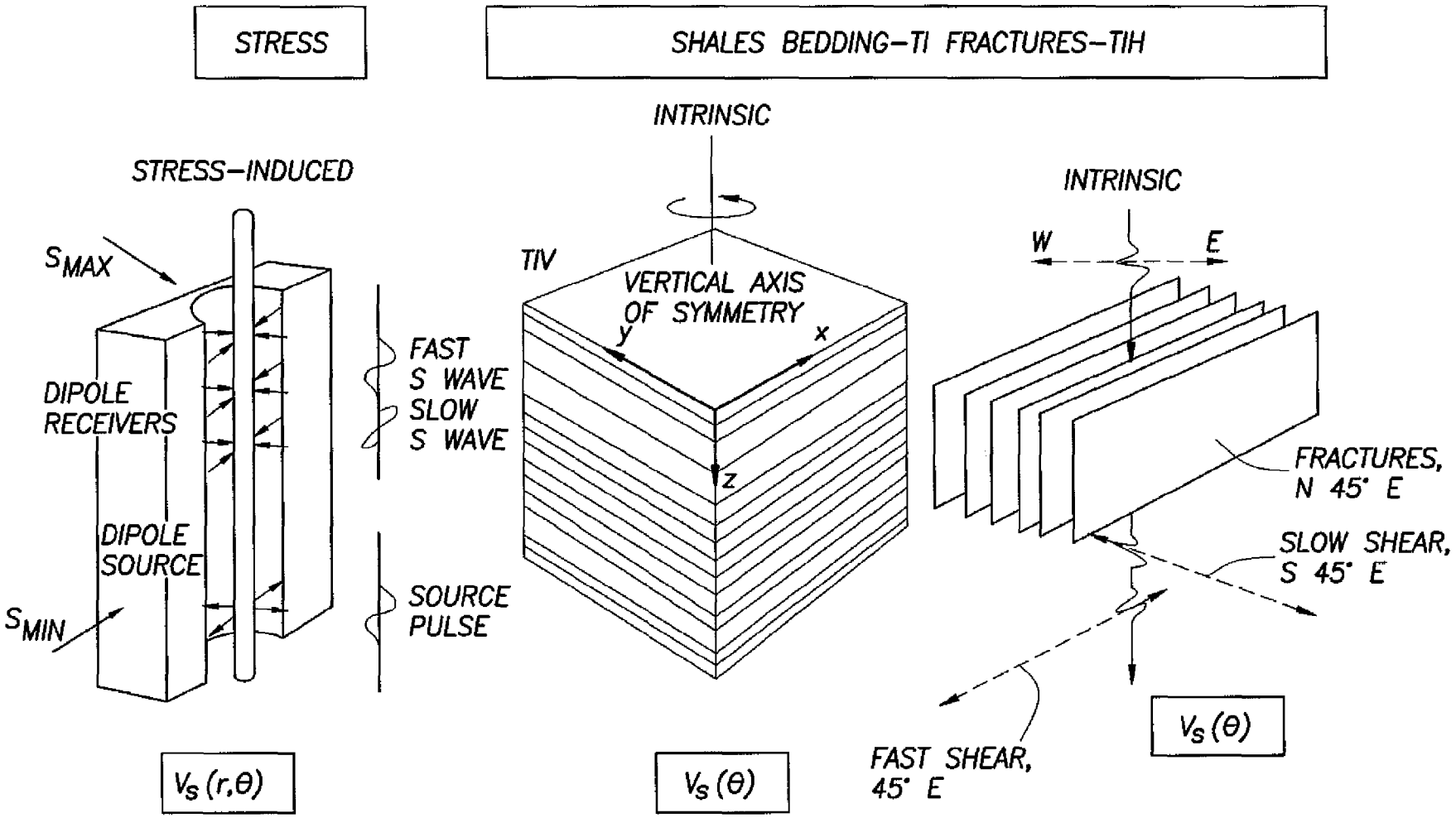
FIG. 10 shows mechanisms contributing to the anisotropy based on a geomechanical model.

FIG. 10 shows a variety of mechanisms contributing to the anisotropy based on a geomechanical model. In FIG. 10, the anisotropy is shown to be caused from a variety of mechanisms known to one skilled in the art. One of the varieties of mechanisms is a stress-induced mechanism.

Figure 11:
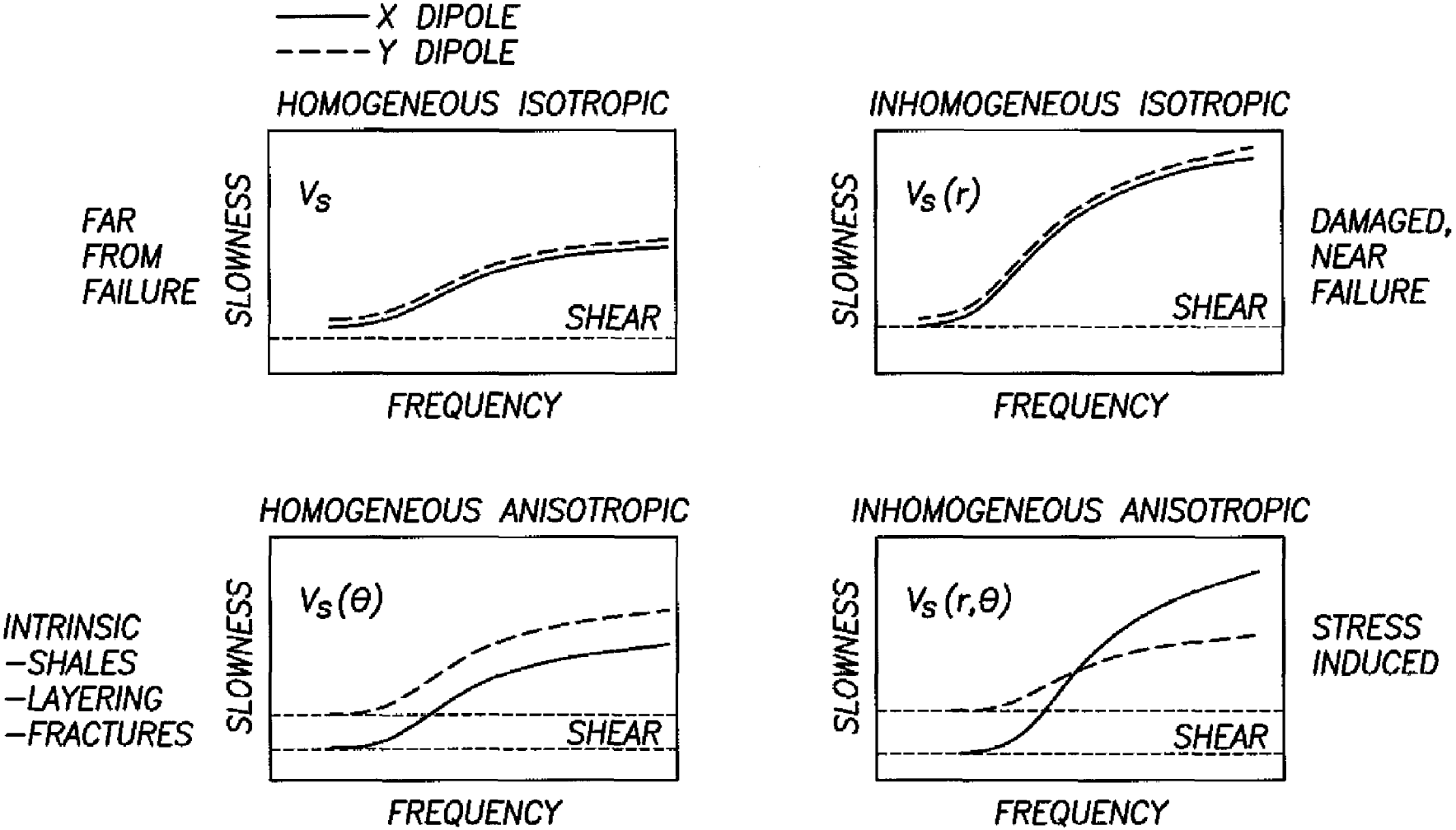
FIG. 11 shows identifying the contributing mechanism to the anisotropy using dispersion curve analysis based on the geomechanical model.

FIG. 11 identifies the contributing mechanism to the anisotropy using dispersion curve analysis based on the geomechanical model. FIG. 11 shows four different characteristics of dispersion curves, which can be used to identify the contributing mechanism of the anisotropy by one skilled in the art. The characteristics shown in the upper two plots, where the slowness measurements corresponding to X Dipole and Y Dipole coincide with each other, indicate isotropy which is attributed to failures from wither far or near distance. The characteristics shown in the lower left plot, where the slowness measurements corresponding to X Dipole and Y Dipole are parallel to each other, indicate anisotropy attributed to intrinsic mechanism such as shales, layering, or fractures. The characteristics shown in the lower right plot, where the slowness measurements corresponding to X Dipole and Y Dipole intersect each other, indicate anisotropy attributed to stress-induced mechanism.

Figure 12:
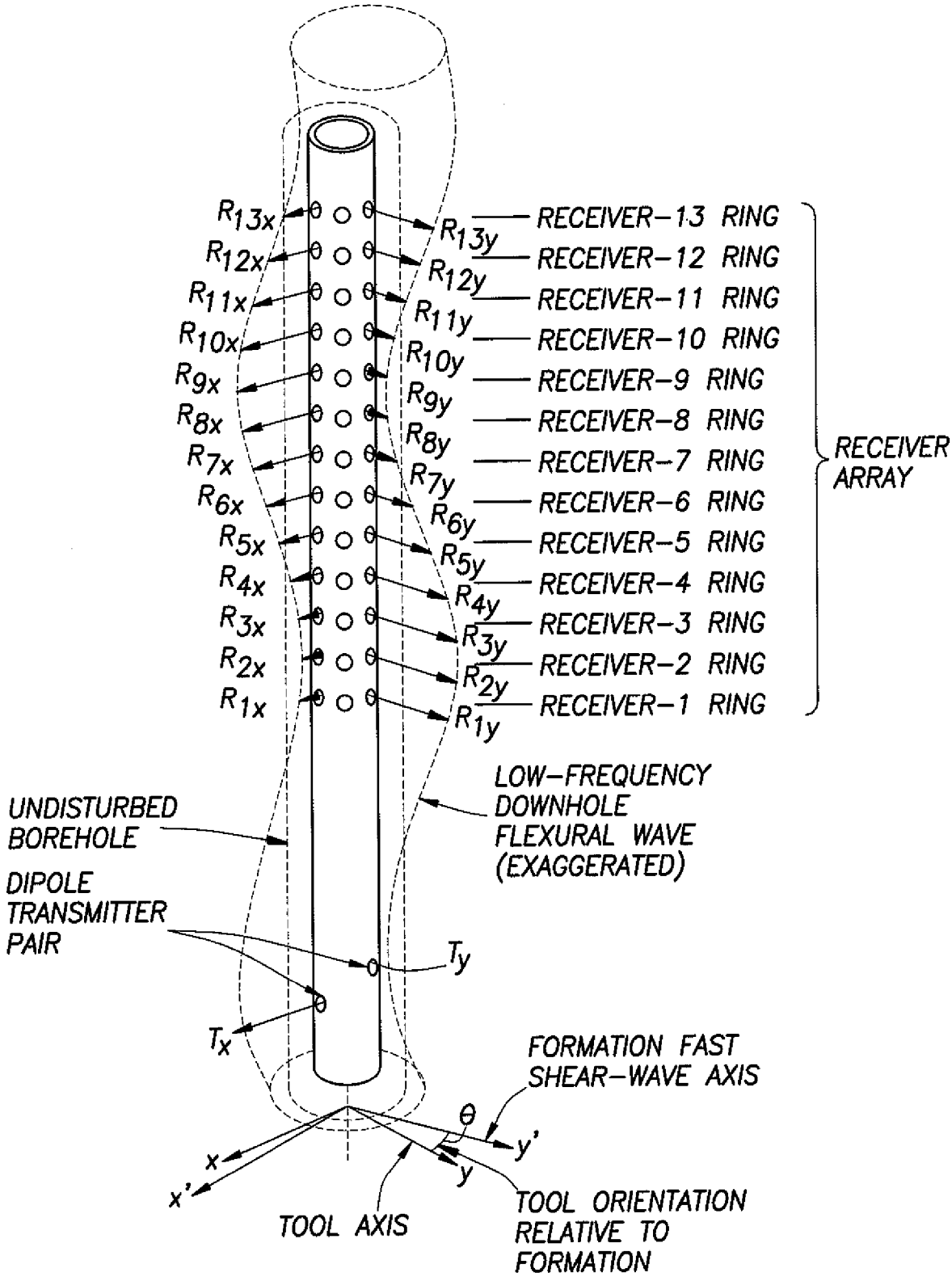
FIG. 12 shows an acoustic scanning device used for acquiring dispersion curve measurements in accordance with aspects of the invention.

FIG. 12 shows an acoustic scanning device used for acquiring dispersion curve measurements in accordance with aspects of the invention. The Acoustic scanning device and dispersion curve analysis are used to determine stress direction in the proximity of an oil well. Here, a pair of dipole transmitters $T_x$ and $T_y$ is shown with two sets of thirteen receivers marked $R_{1x}$ through $R_{13x}$ and $R_{1y}$ through $R_{13y}$ mounted inside a wellbore at certain depth. The receivers marked $R_{1x}$ through $R_{13x}$ are said to be inline receiver with respect to $T_x$ and cross receiver with respect to $T_y$. The receivers marked $R_{1y}$ through $R_{13y}$ are said to be cross receiver with respect to $T_x$ and inline receiver with respect to $T_y$. As the acoustic scanning device is lowered to various different depths inside the wellbore, the receivers record waveforms produced from $T_x$ and $T_y$. The waveforms are stored for further analysis.

Figure 13:
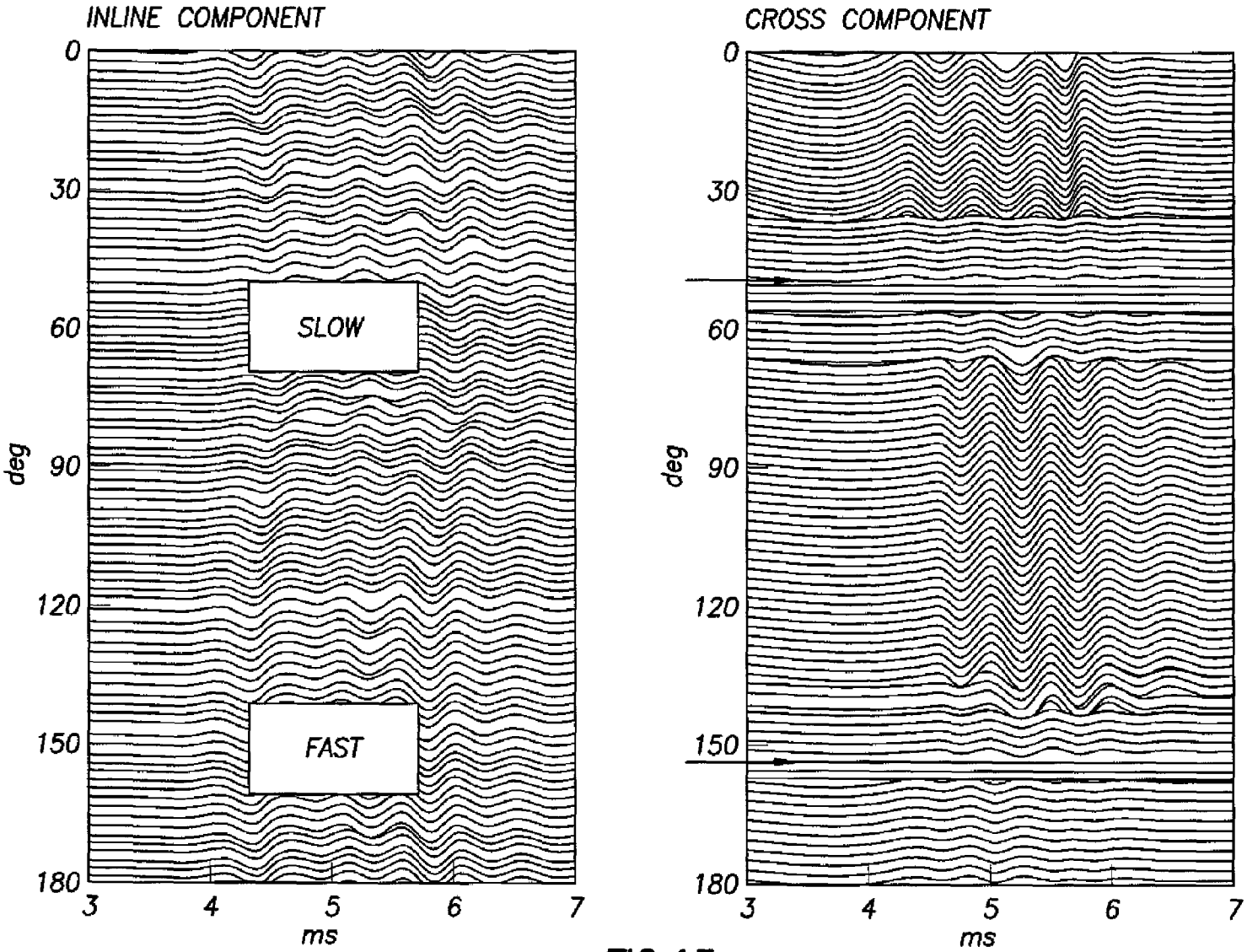
FIG. 13 shows measurements acquired from the acoustic scanning device shown in FIG. 12 in accordance with aspects of the invention.

FIG. 13 shows measurements acquired from the acoustic scanning device shown in FIG. 12 in accordance with aspects of the invention. The graph marked "inline component" shows measurements taken from inline receivers with respect to $T_x$ or $T_y$. The inline component measurements correspond to maximum energy. The graph marked "cross component" includes measurements taken from cross receivers with respect to $T_x$ or $T_y$. The cross component measurements correspond to minimum energy. The horizontal axes of the graphs represent delay time in ms and the vertical axes of the graphs represent angle in degrees. The change in amplitude between the inline component and the cross component defines the anisotropy.

Figure 14:
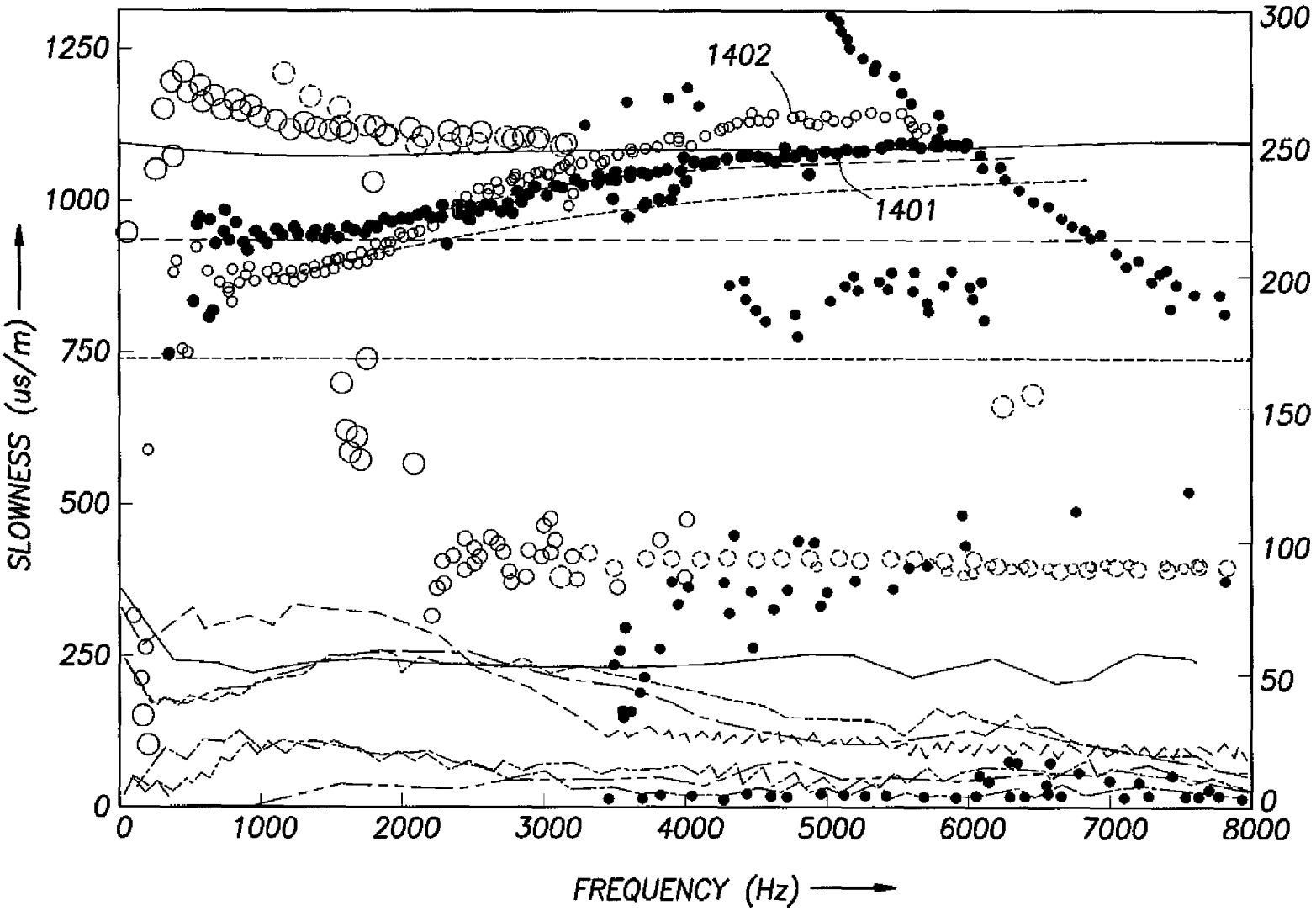
FIG. 14 shows a dispersion curve measurement plot, corresponding to FIG. 15, in accordance with aspects of the invention.

FIG. 14 shows a dispersion curve measurement plot in accordance with aspects of the invention. These measurements have been acquired from the oil well corresponding to FIG. 15 at a depth of 487.528 m subsurface. The crossing of the blue curve 1401 and the red curve 1402 at approximately 1000 us/m slowness and 2000 Hz Frequency identifies anisotropy as being originated from a stress-induced mechanism using the scheme shown in FIG. 11. This identification demonstrates the presence of stress in the proximity of the oil well corresponding to FIG. 15. Further, the direction of minimum and maximum stress may be derived using measurements, such as those in FIG. 13, acquired by the acoustic scanning device, if operated in conjunction with a directional survey tool.

Figures 15, 15A:
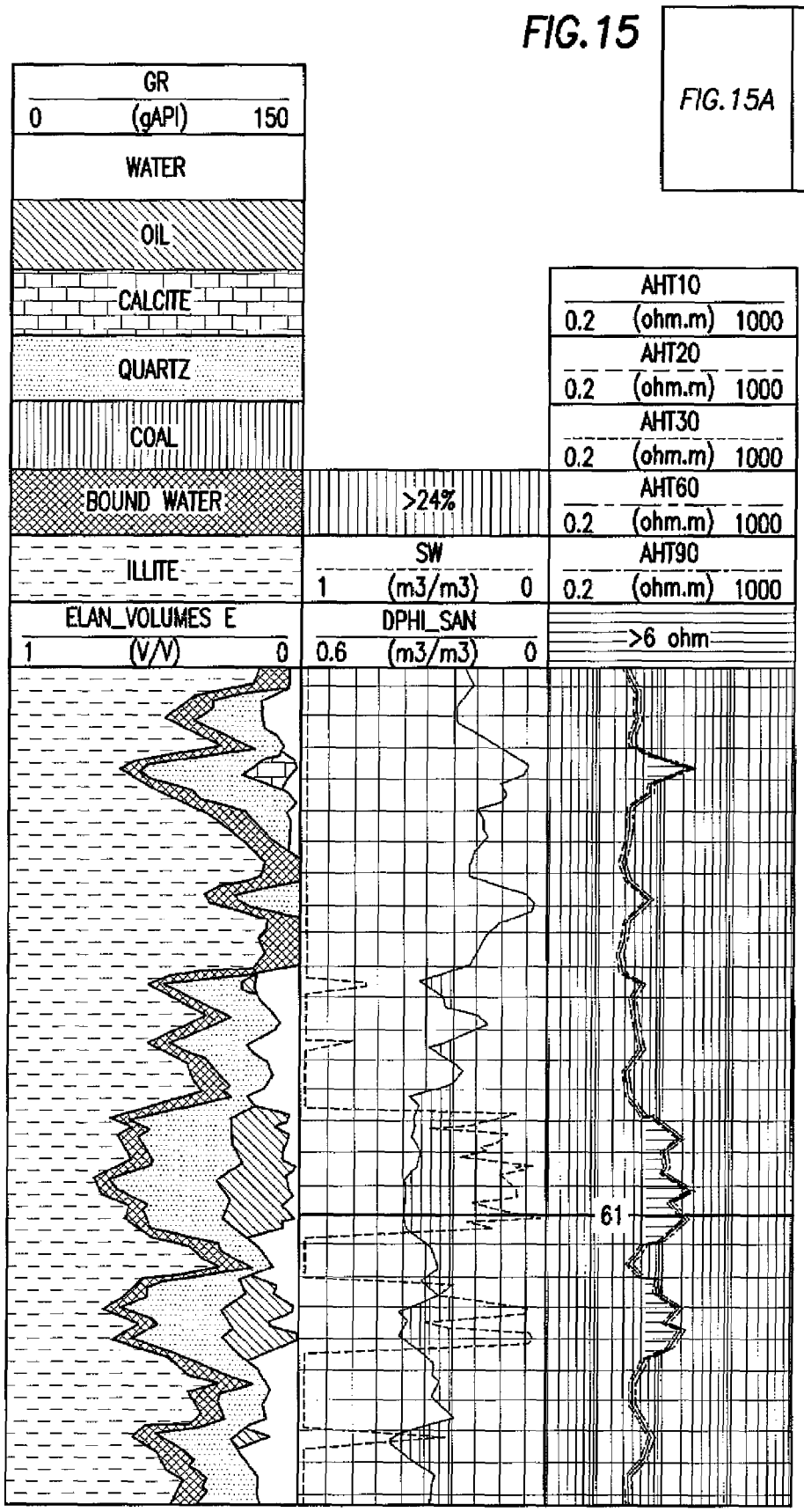
FIG. 15 shows an exemplary log measurement showing anisotropy and minimum stress direction in accordance with aspects of the invention.
Figure 15B:
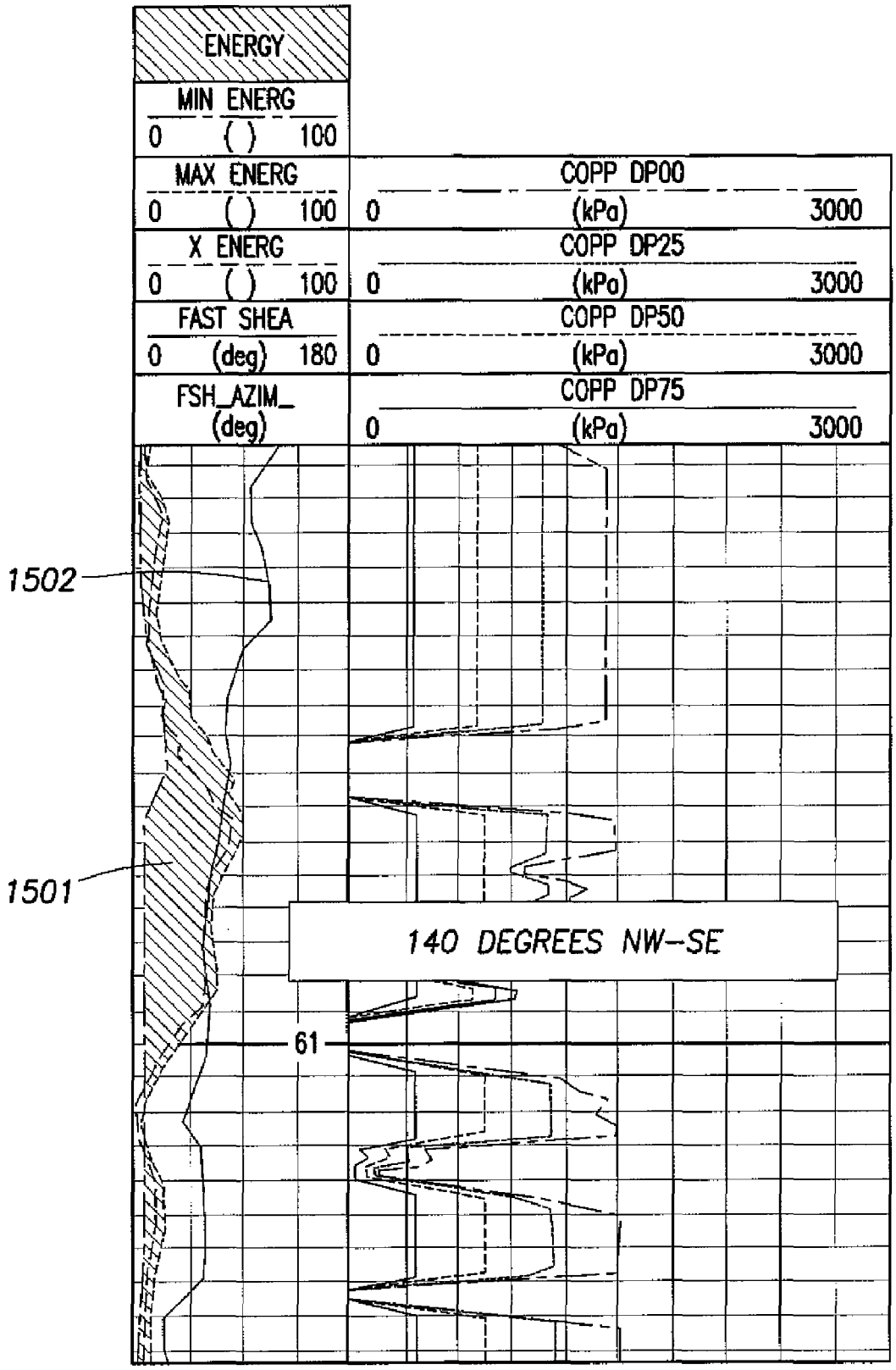

FIG. 15 shows a log measurement showing anisotropy and maximum stress direction in accordance with aspects of the invention. In FIG. 15, the location near where marked "61" corresponds to porosity greater than 24 percent resistivity greater than 6 ohm.m, and CDPP near zero. These conditions predict sand failure for wormholes to develop. Additionally, the minimum energy and maximum energy measurements are plotted with the difference between them marked in location 1501. The very noticeable band indicates the presence of anisotropy in the proximity of this oil well. The result from FIG. 14 identifies the presence of stress-induced mechanism in the proximity of this oil well. The maximum stress direction is derived and plotted as the curve 1502 indicated as "Fast Shear" by the legend. Wormholes developed in the vicinity of where it is marked "61" will propagate in the minimum stress direction, which is along a direction rotated 90 degrees from the maximum stress direction indicated by the curve 1502. The wormholes propagation is based on depositional geology. In this case, a sand channel can be predicted by looking at the minimum stress direction. In other eases, where a large sand area is not contained by restrictive formation (e.g., a shale formation), propagation of the sand channel may also be along the maximum stress direction.

Figure 16:
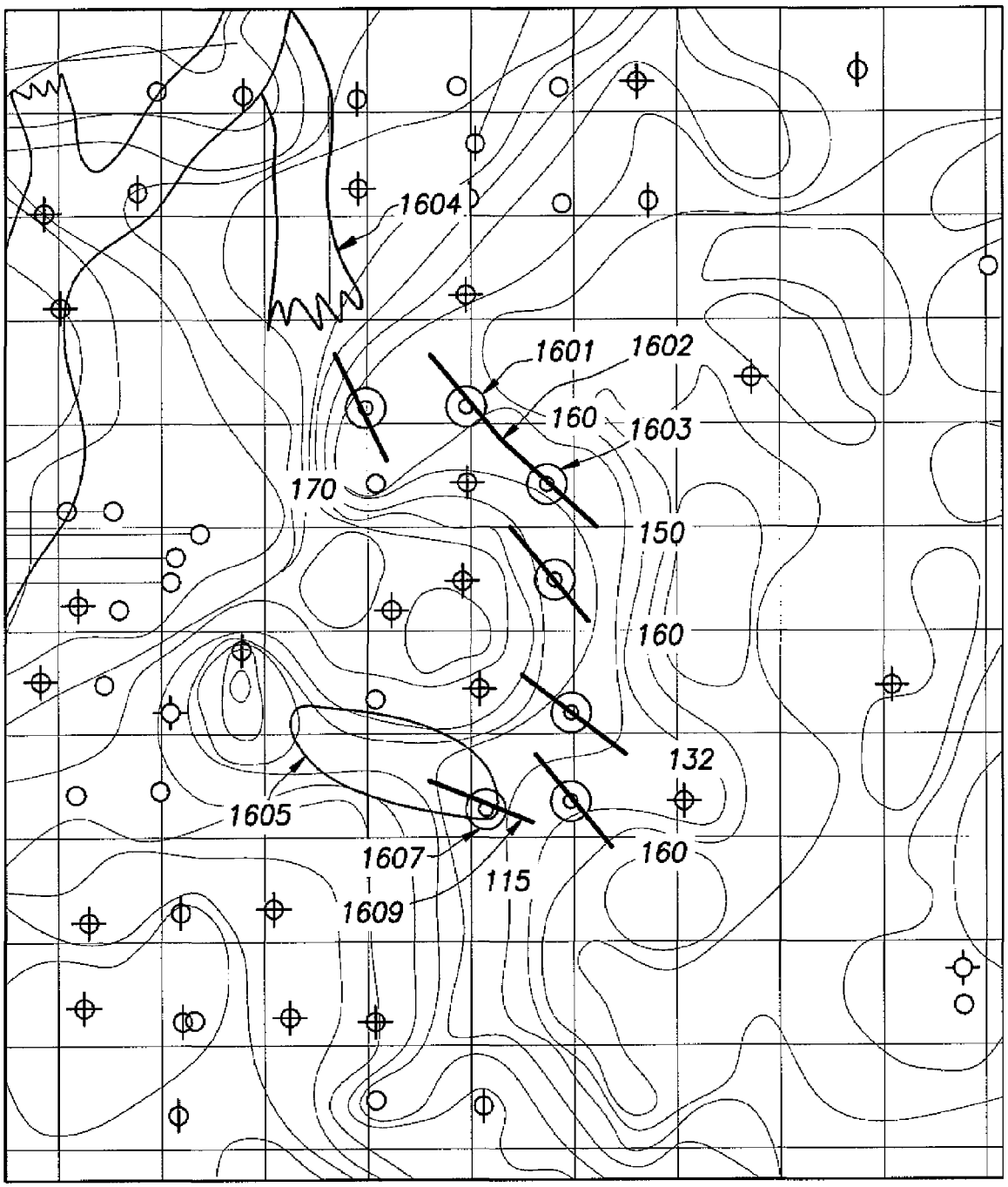
FIG. 16 shows a structure map in accordance with aspects of the invention.

FIG. 16 shows a structure map in accordance with aspects of the invention. Here, the perimeter 1604 with jagged end represents a high permeability channel of sand. The black dots inside circles represent oil wells under study. The line segments represent minimum stress directions through each oil well. The numbers (e.g., 115, 132, 150, 160, 170) corresponding to the line segments indicate the directions in degrees with north being at zero degree and south being at 180 degrees. These minimum stress directions can be derived using the method described above. It is predicted that the sand channel 1604 will trend along the general direction of these line segments of minimum stress directions. It is further predicted that as wormholes develop from one oil well along the minimum stress direction and propagate toward an intersection with another oil well, the pressure regime will change drastically thus render both oil wells non-productive. For example, the two oil wells 1601 and 1603 may have their wormholes propagate towards each other along the minimum stress direction, represented by the line segment 1602, and ultimately intersect. In this case the productivity of both oil wells will be drastically reduced. In another example, it is necessary to avoid placing additional oil wells along either the minimum stress direction or the maximum stress direction within certain range from each of the corresponding oil well to maintain daily oil output productivity. The range may be dependent on characteristics of specific field location and may be modeled by a geomechanical model. For example, a no drilling zone 1605 may be established within a range from the oil well 1607 along a minimum stress direction represented by line segment 1609.

Figure 17:
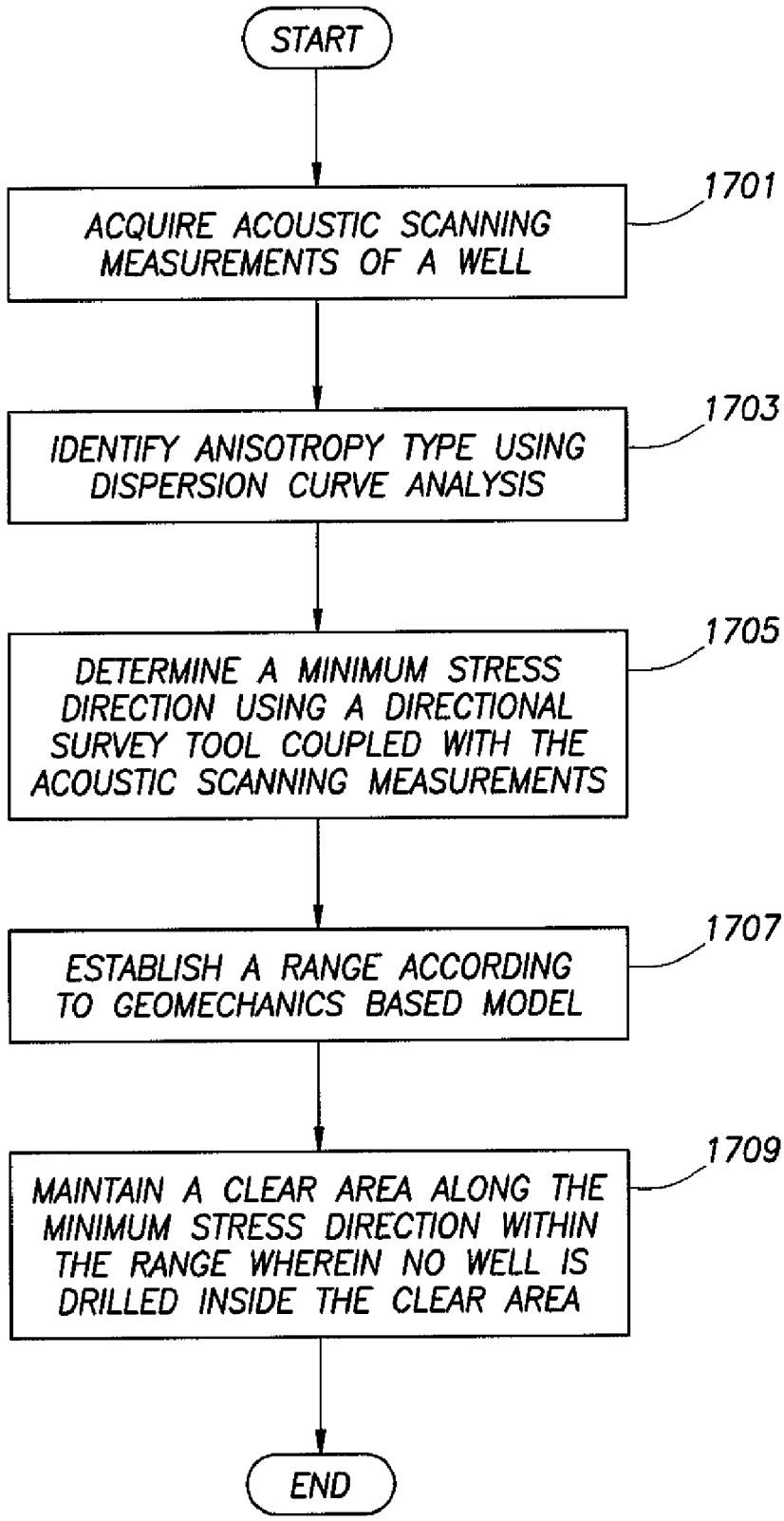
FIG. 17 shows a flow chart of a method for preventing loss in CHOPS zonal productivity in accordance with aspects of the invention.

FIG. 17 shows a flow chart of a method for preventing loss in zonal productivity in accordance with aspects of the invention. Initially, acoustic scanning measurements of a well are acquired Step 1701. The acoustic scanning measurements may be acquired from one or more array of acoustic receivers positioned some distance away from a dipole transmitter pair. An acoustic receiver array may be configured in an inline position with respect to a dipole transmitter. Another acoustic receiver array may be configured in a cross line position with respect to the dipole transmitter. The receiver arrays and the dipole transmitters may be positioned at various different depths along the wellbore for acquiring the acoustic scanning measurements. The measurements may be acquired at different frequency originated from the dipole transmitters. Once the acoustic scanning measurements are acquired, the anisotropy type is determined using dispersion curve analysis Step 1703. The inline component and the cross line component of the acoustic scanning measurements define the anisotropy type. If both measurements coincide with each other, the anisotropy is not present. If both measurements are parallel to each other, the anisotropy is present and is attributed to various intrinsic mechanism such as shales, layering, or fractures. If the inline component and the cross line component of the acoustic scanning measurements intersect each other on the plotted dispersion curve, the anisotropy is present and is attributed to stress-induced mechanism. Once the presence of stress is identified, a minimum and maximum stress direction is determined using a directional survey tool coupled with the acoustic scanning measurements Step 1705. By orienting the acoustic scanning device at various different directions, the acoustic scanning measurements can be analyzed to determine a slow direction and a fast direction. These directions can then be correlated to maximum and minimum energy and stress directions. Subsequently, a range may be determined according to a geomechanics based model to estimate the distance of wormhole propagation Step 1707. It is important to avoid wormholes from two oil wells within this range to line up along the minimum or maximum stress direction such that their wormholes may propagate and intersect each other and negatively impact the productivity of both oil wells. Accordingly, a clear area, or a no drilling zone, along the minimum or maximum stress direction within the range is maintained where no additional oil wells will be drilled inside this clear area Step 1709.

Figure 18:
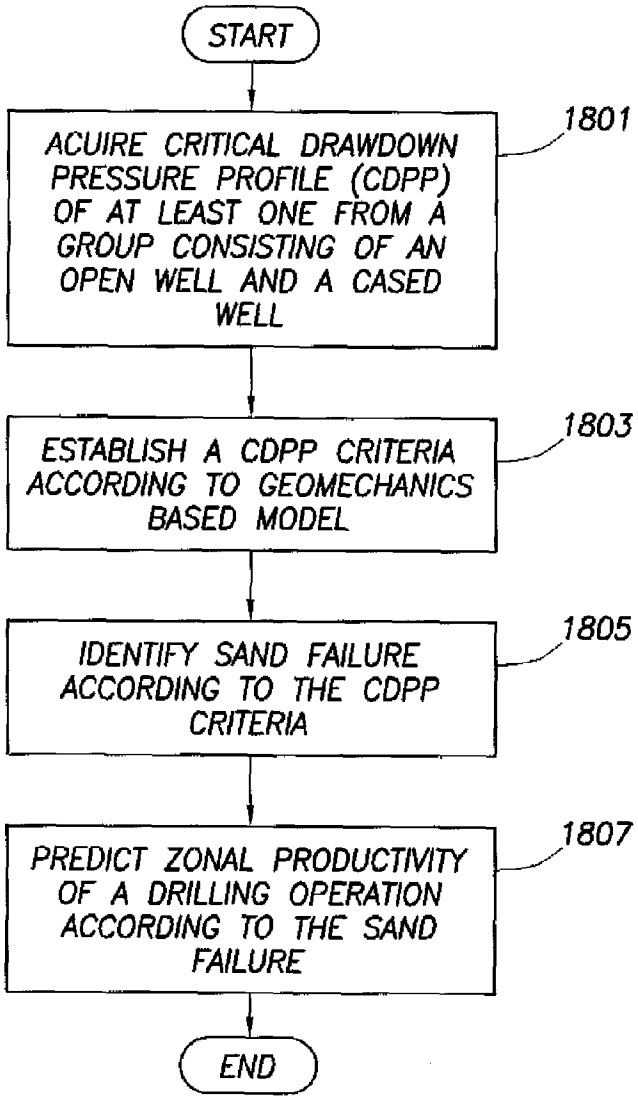
FIG. 18 shows a computer system in accordance with aspects of the invention.

FIG. 18 shows a flow chart of a method for predicting zonal productivity in accordance with aspects of the invention. Initially, critical drawdown pressure profile (CDPP) of an open well or a cased well is acquired Step 1801. The CDPP is measured as pressure difference between the formation and the wellbore. This measurement can be performed using various instruments and tools that are commercially available. The technique of measuring CDPP is well known to one skilled in the art. Secondly, a criteria is established relating to the level of CDPP sufficient to initiate sand failure in the proximity of target drilling area according to a geomechanics based model Step 1803. Depending on the porosity and permeability of the sandstone formation, the CDPP criteria may be adjusted accordingly. Once the CDPP criteria are established, sand failure may be identified at various depths in the proximity of a well Step 1805. For highly compacted formation, the CDPP may be too high to allow sand failure to initiate. Using log measurements, such as illustrated in FIG. 4, 6, 8, or 15, zonal productivity may be predicted of a drilling operation and suitable locations may be identified along the depth of the wellbore where CDPP is sufficiently low to be productive targets for perforation Step 1807.

Figure 19:
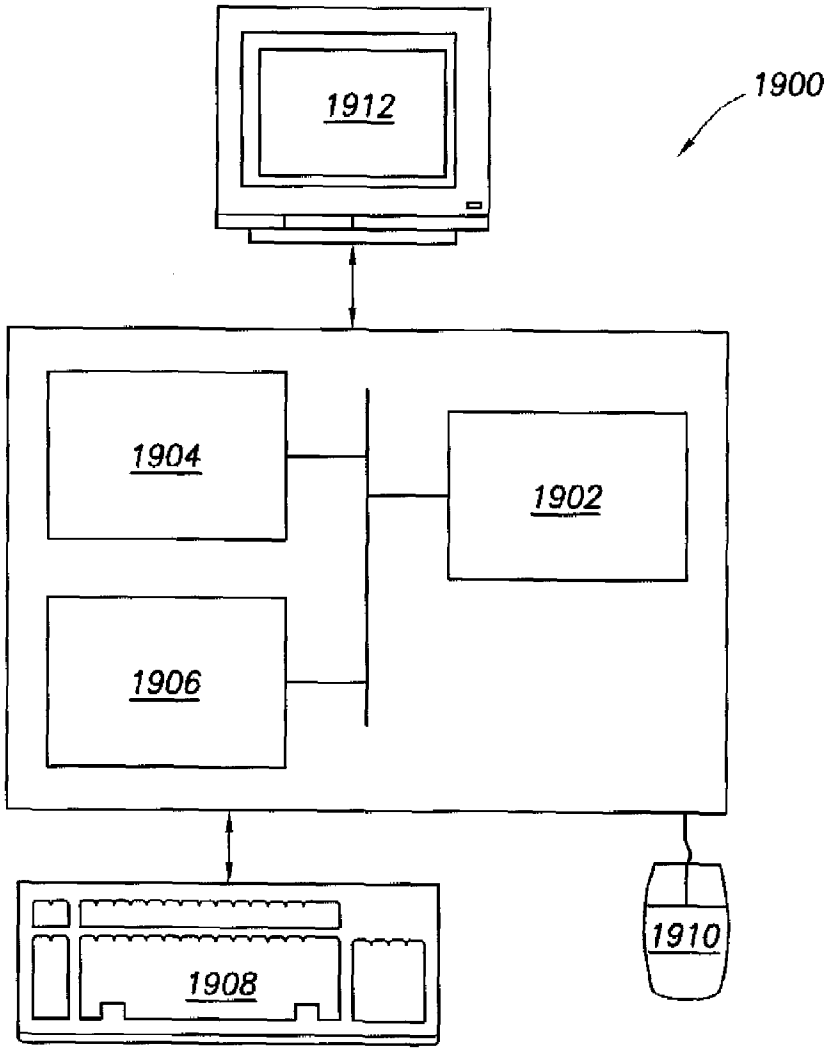
FIG. 19 shows a cross-section of a drilling operation in accordance with aspects of the invention.

The invention may be implemented on virtually any type of computer regardless of the platform being used. For example, as shown in FIG. 19, a computer system 1900 includes a processor 1902, associated memory 1904, a storage device 1906, and numerous other elements and functionalities typical of today's computers (not shown). The computer 1900 may also include input means, such as a keyboard 1908 and a mouse 1910, and output means, such as a monitor 1912. The computer system 1900 is connected to a local area network (LAN) or a wide area network (e.g., the Internet) (not shown) via a network interface connection (not shown). Those skilled in the art will appreciate that these input and output means may take other forms.

Further, those skilled in the art will appreciate that one or more elements of the aforementioned computer system 1900 may be located at a remote location and connected to the other elements over a network. Further, the invention may be implemented on a distributed system having a plurality of nodes, where each portion of the invention may be located on a different node within the distributed system. In aspects of the invention, the node corresponds to a computer system. Alternatively, the node may correspond to a processor with associated physical memory. The node may alternatively correspond to a processor with shared memory and/or resources.

Further, software instructions to perform embodiments of the invention may be stored on a computer readable medium such as a compact disc (CD), a diskette, a tape, a file, or any other computer readable storage device.

Figure 20:
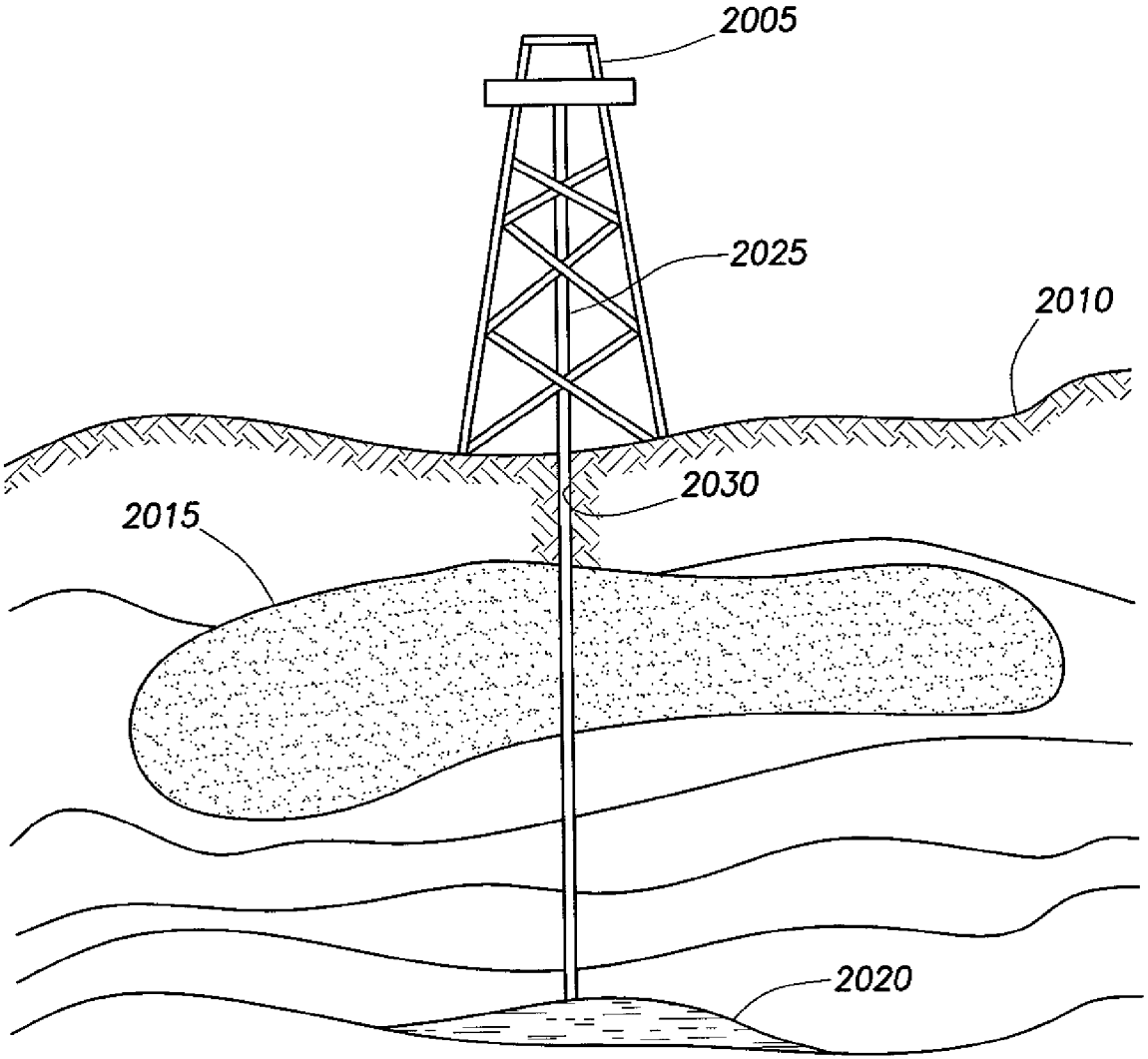
FIG. 20 shows a cross-section of a drilling operation and distinct subsurface structures.

FIG. 20 shows a cross-section of a drilling operation and distinct subsurface structures. A drilling rig 2005 may be established at a surface 2010 (e.g., earth surface, subsea surface, seafloor, etc.). Workers on the drilling rig extend a drill string 2025 which may penetrate formations 2030 at the surface 2010. Below the surface 2010 varying mineral structures may exist. For example, a low permeability substance 2015 may extend over a target substance 2020. Visualization tools of the prior art rely on seismic wave penetration, reflection and modification by target substance 2020 to reveal the nature and desirability of performing drilling operations to obtain the target substance. Although many examples have been given relating to oil wells, the invention may also be practiced in wells configured to extract other subsurface mineral substances, such as liquid, gas, and the like.

Embodiments of the invention may include one or more advantages, such as input data can be captured in open or cased hole, the ability to predict more economical and producible zones, reduce costs by not completing sands that are less likely to fail and therefore have low production, the ability to tell direction of wormholes for well placement. Further, by predicting wormhole growth direction, the operator can eliminate wormholes intersecting nearby wells causing lost circulation and killed production in the intersected well and well spacing can be optimized to maximize resource recovery.

While the invention has been described with respect to a limited number of embodiments and advantages, those skilled in the art, having benefit of this disclosure, will appreciate that other embodiments and advantages can be devised which do not depart from the scope of the invention as disclosed herein. Accordingly, the scope of the invention should be limited only by the attached claims.

What is claimed is:

1. A method for performing operations of an oilfield having at least one wellsite, a surface network, and a process facility, each wellsite having a wellbore penetrating a subterranean formation for extracting fluid from an underground reservoir therein, the method comprising:

acquiring a critical drawdown pressure profile (CDPP) of a well, wherein the CDPP is generated based on pressure measurements obtained from the well;

establishing a CDPP criteria according to a geomechanics based model;

identifying sand failure according to the CDPP and the CDPP criteria;

predicting zonal productivity of a drilling operation according to the sand failure;

acquiring directional logging information using a directional survey tool;

predicting a direction of the sand failure based on the directional logging information; and performing the operations of the oilfield based on the zonal productivity, wherein the operations are performed while maintaining a no drilling zone adjacent to the well along the direction of the sand failure.

2. The method of claim 1, wherein the geomechanics based model comprises minimum and maximum energy measurements, stress induced anisotropy measurements, and shear component of stress measurements.

3. The method of claim 2, wherein the CDPP criteria is established based on correlating the CDPP profile with at least one selected from a group consisting of the minimum and maximum energy measurements, the stress induced anisotropy measurements, and the shear component of stress measurements.

4. The method of claim 3, wherein the sand failure is identified based on the CDPP profile exceeding the CDPP criteria.

5. A method for performing operations of an oilfield having at least one wellsite, a surface network, and a process facility, each wellsite having a wellbore penetrating a subterranean formation for extracting fluid from an underground reservoir therein, the method comprising:

acquiring a critical drawdown pressure profile (CDPP) of a well, wherein the CDPP is generated based on pressure measurements obtained from the well;

identifying sand failure according to the CDPP;

predicting zonal productivity of a drilling operation according to the sand failure;

predicting a direction of the sand failure based on a geomechanics based model in proximity of a well and using a directional survey tool; and performing the operations of the oilfield based on the zonal productivity, wherein the operations are performed while maintaining a no drilling zone adjacent to the well along the direction of the sand failure.

6. The method of claim 5, wherein predicting the direction of the sand failure comprises:

acquiring acoustic scanning measurements of the well;

identifying anisotropy type using dispersion curve analysis;

determining at least one direction selected from a group consisting of minimum stress direction and maximum stress direction in the proximity of the well using the directional survey tool coupled with the acoustic scanning measurements; and predicting the direction of the sand failure based on the at least one direction.

7. The method of claim 5, wherein the geomechanics based model comprises minimum and maximum energy measurements, stress induced anisotropy measurements, and shear component of stress measurements.

8. A computer readable medium, embodying instructions executable by the computer to perform method steps for performing operations of an oilfield having at least one wellsite, a surface network, and a process facility, each wellsite having a wellbore penetrating a subterranean formation for extracting fluid from an underground reservoir therein, the instructions comprising functionality to:

acquire a critical drawdown pressure profile (CDPP) of a well, wherein the CDPP is generated based on pressure measurements obtained from the well;

establish a CDPP criteria according to a geomechanics based model;

identify sand failure according to the CDPP and the CDPP criteria;

predict zonal productivity of a drilling operation according to the sand failure;

acquire directional logging information using a directional survey tool;

predict a direction of the sand failure based on the directional logging information; and perform the operations of the oilfield based on the zonal productivity, wherein the operations are performed while maintaining a no drilling zone adjacent to the well along the direction of the sand failure.

9. The computer readable medium of claim 8, wherein the geomechanics based model comprises minimum and maximum energy measurements, stress induced anisotropy measurements, and shear component of stress measurements.

10. The computer readable medium of claim 9, wherein the CDPP criteria is established based on correlating the CDPP profile with at least one selected from a group consisting of the minimum and maximum energy measurements, the stress induced anisotropy measurements, and the shear component of stress measurements.

11. The computer readable medium of claim 10, wherein the sand failure is identified based on the CDPP profile exceeding the CDPP criteria.

12. A computer readable medium, embodying instructions executable by the computer to perform method steps for performing operations of an oilfield having at least one wellsite, a surface network, and a process facility, each wellsite having a wellbore penetrating a subterranean formation for extracting fluid from an underground reservoir therein, the instructions comprising functionality to:

acquire a critical drawdown pressure profile (CDPP) of a well, wherein the CDPP is generated based on pressure measurements obtained from the well;

identify sand failure according to the CDPP;

predict zonal productivity of a drilling operation according to the sand failure;

predict a direction of the sand failure based on a geomechanics based model in proximity of a well and using a directional survey tool; and perform the operations of the oilfield based on the zonal productivity, wherein the operations are performed while maintaining a no drilling zone adjacent to the well along the direction of the sand failure.

13. The computer readable medium of claim 12, wherein predicting the direction of the sand failure comprises:

acquiring acoustic scanning measurements of the well;

identifying anisotropy type using dispersion curve analysis;

determining at least one direction selected from a group consisting of a minimum stress direction and a maximum stress direction in the proximity of the well using a directional survey tool coupled with the acoustic scanning measurements; and predicting the direction of the sand failure based on the at least one direction.

14. The computer readable medium of claim 12, wherein the geomechanics based model comprises minimum and maximum energy measurements, stress induced anisotropy measurements, and shear component of stress measurements.

15. A computer system comprising:

a memory comprising a set of instructions; and a processor operatively coupled to the memory, wherein the processor executes the set of instructions to:

acquire a critical drawdown pressure profile (CDPP) of a well, wherein the CDPP is generated based on pressure measurements obtained from the well;

establish a CDPP criteria according to a geomechanics based model;

identify sand failure according to the CDPP and the CDPP criteria;

predict zonal productivity of a drilling operation according to the sand failure;

acquiring directional logging information using a directional survey tool;

predicting a direction of the sand failure based on the directional logging information; and performing the operations of the oilfield based on the zonal productivity, wherein the operations are performed while maintaining a no drilling zone adjacent to the well along the direction of the sand failure.

16. The computer system of claim 15, wherein the geomechanics based model comprises minimum and maximum energy measurements, stress induced anisotropy measurements, and shear component of stress measurements.

17. The computer system of claim 16, wherein the CDPP criteria is established based on correlating the CDPP profile with at least one selected from a group consisting of the minimum and maximum energy measurements, the stress induced anisotropy measurements, and the shear component of stress measurements.

18. The computer system of claim 17, wherein the sand failure is identified based on the CDPP profile exceeding the CDPP criteria.

* * * * *